US007446272B2

(12) United States Patent
Chou

(10) Patent No.: US 7,446,272 B2
(45) Date of Patent: Nov. 4, 2008

(54) ROLLING-BALL SWITCH

(76) Inventor: Tien-Ming Chou, No. 41, San-Hsi 5th St., Taichung City (TW)

( * ) Notice: Subject to any disclaimer, the term of this patent is extended or adjusted under 35 U.S.C. 154(b) by 170 days.

(21) Appl. No.: 11/535,874

(22) Filed: Sep. 27, 2006

(65) Prior Publication Data

US 2008/0073194 A1 Mar. 27, 2008

(51) Int. Cl.
*H01H 35/02* (2006.01)
*H01H 35/14* (2006.01)

(52) U.S. Cl. ..... 200/61.45 R; 200/61.52

(58) Field of Classification Search ..... 200/61.45 R, 200/61.46–61.48, 61.5, 61.52; 340/546, 340/429, 566, 565
See application file for complete search history.

(56) References Cited

U.S. PATENT DOCUMENTS 4,778,964 A 10/1988 Kamisada
5,208,430 A 5/1993 Ludzia
5,213,314 A 5/1993 Kano et al.
5,920,045 A 7/1999 Suzuki et al.
5,977,497 A 11/1999 Tsunematsu
6,028,275 A 2/2000 Jou
6,096,990 A 8/2000 Marin
6,448,516 B1 * 9/2002 Chiang ..... 200/61.45 R
6,559,396 B1 * 5/2003 Chou ..... 200/61.52
7,045,724 B1 5/2006 Chou
7,256,360 B1 * 8/2007 Chou ..... 200/61.45 R
7,319,200 B2 * 1/2008 Chou ..... 200/61.45 R

* cited by examiner

*Primary Examiner*—Elvin G Enad
*Assistant Examiner*—Marina Fishman
(74) *Attorney, Agent, or Firm*—Sheridan Ross P.C.

(57) ABSTRACT

A rolling-ball switch includes a housing defining a chamber and having a bottom wall provided with four spaced-apart through holes, and two conducting units respectively having plate-like connecting members disposed in parallel below the bottom wall. Each connecting member has at least one abutment surface in abutment with the bottom wall, and first, second, and third connecting surfaces adapted to be selectively fixed on a circuit board. Each conducting unit further includes two terminals extending into the chamber via the corresponding through holes and being spaced apart from each other in a longitudinal direction of the corresponding connecting member. A conductive ball is disposed movably in the chamber to move toward or away from the terminals.

14 Claims, 27 Drawing Sheets

ROLLING-BALL SWITCH

BACKGROUND OF THE INVENTION

1. Field of the Invention

The invention relates to a switch, more particularly to a rolling-ball switch that is mounted on a circuit board for changing between OFF and ON states.

2. Description of the Related Art

Referring to FIGS. 1 to 3, a conventional switch 10, as disclosed by the applicant in Taiwanese Patent No. 155965, includes a housing, a conductive ball 12, and four terminal rods 14.

The housing includes a bottom seat 13 and a cover body 11. The bottom seat 13 is made of plastic, and has top and bottom surfaces, and four spaced-apart insert holes 131 extending through the top and bottom surfaces. Each of the insert holes 131 is defined by four interconnected hole walls 132. The cover body 11 is made of plastic, and has a top wall 111, and four interconnected side walls 112 extending downwardly from a peripheral end of the top wall 111. The top wall 111 and the side walls 112 cooperatively define a chamber 113, and a bottom opening 114 opposite to the top wall The bottom seat 13 is inserted into the chamber 113 after the conductive ball 12 is disposed in the latter so as to close the bottom opening 114 and thereby confine the conductive ball 12 within the chamber 113.

The terminal rods 14 are inserted respectively and interferentially into the insert holes 131 by a jig (not shown) so as to position the terminal rods 14 in the respective insert holes 131. Each terminal rod 14 has an inner end 141 located within the chamber 113, an outer end 142 located outwardly of the bottom seat 13, and four interconnected side surfaces 143 that interconnect the inner and outer ends 141, 142.

In use, the outer ends 142 of the terminal rods 14 are inserted respectively into through holes 21 in a circuit board 20, after which the terminal rods 14 are soldered to the circuit board 20, thereby mounting and positioning the switch 10 on the circuit board 20. The switch 10 is tilted or turned so as to shift from an OFF state to an ON state, and vice versa.

Although the aforementioned conventional switch 10 can achieve its intended purpose, it has the following drawbacks:

1. Because the switch 10 can have various applications, the switch 10 is not always mounted uprightly on the circuit board 20, as shown in FIG. 2. For example, the switch 10 can be mounted parallel to the circuit board 20, as shown in FIG. 3. In the latter case, a manufacturer has to bend the terminal rods 14 first, so that the user, after purchasing the switch 10, can directly insert and solder the terminal rods 14 to the circuit board 20. Further, the switch 10 must have bendable terminal rods 14 in order to allow such re-shaping thereof. Hence, the conventional switch 10 may have a very complicated manufacturing process in the case where such bending is required, and has a high production cost due to the fact that high-cost bendable material is required for the terminal rods 14.

2. Because each terminal rod 14 is configured as a single individual body, when the terminal rods 14 are inserted respectively into the insert holes 131, it is difficult to control the lengths of the inner ends 141 of the terminal rods 14 that extend into the chamber 113. Hence, difficulties are encountered with respect to controlling the quality of the conventional switch 10.

3. Since the side surfaces 143 of the terminal rods 14 are smooth, connections between the side surfaces 143 and the hole walls 132 of the insert holes 131 are weak and unstable.

SUMMARY OF THE INVENTION

Therefore, the object of the present invention is to provide a rolling-ball switch that is capable of overcoming the aforementioned drawbacks of the prior art.

According to this invention, a rolling-ball switch is adapted to be fixed on a circuit board. The rolling-ball switch comprises a housing, two conducting units, and a conductive ball. The housing defines a chamber, and has a bottom wall provided with four spaced-apart through holes arranged in a rectangular array. The conducting units respectively have plate-like connecting members disposed in parallel below the bottom wall. Each of the connecting members has at least one abutment surface in abutment with the bottom wall, a first connecting surface opposite to the abutment surface, and second and third connecting surfaces extending between the abutment surface and the first connecting surface. Each of the conducting units further includes two terminals extending upwardly from the abutment surface of one of the connecting members into the chamber and passing respectively through two of the through holes. The two terminals are spaced apart from each other in a longitudinal direction of a corresponding one of the connecting members. The second and third connecting surfaces are opposite to each other in the longitudinal direction. The first, second, and third connecting surfaces are adapted to be selectively fixed on the circuit board. The conductive ball is disposed movably in the chamber to move toward or away from the terminals.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
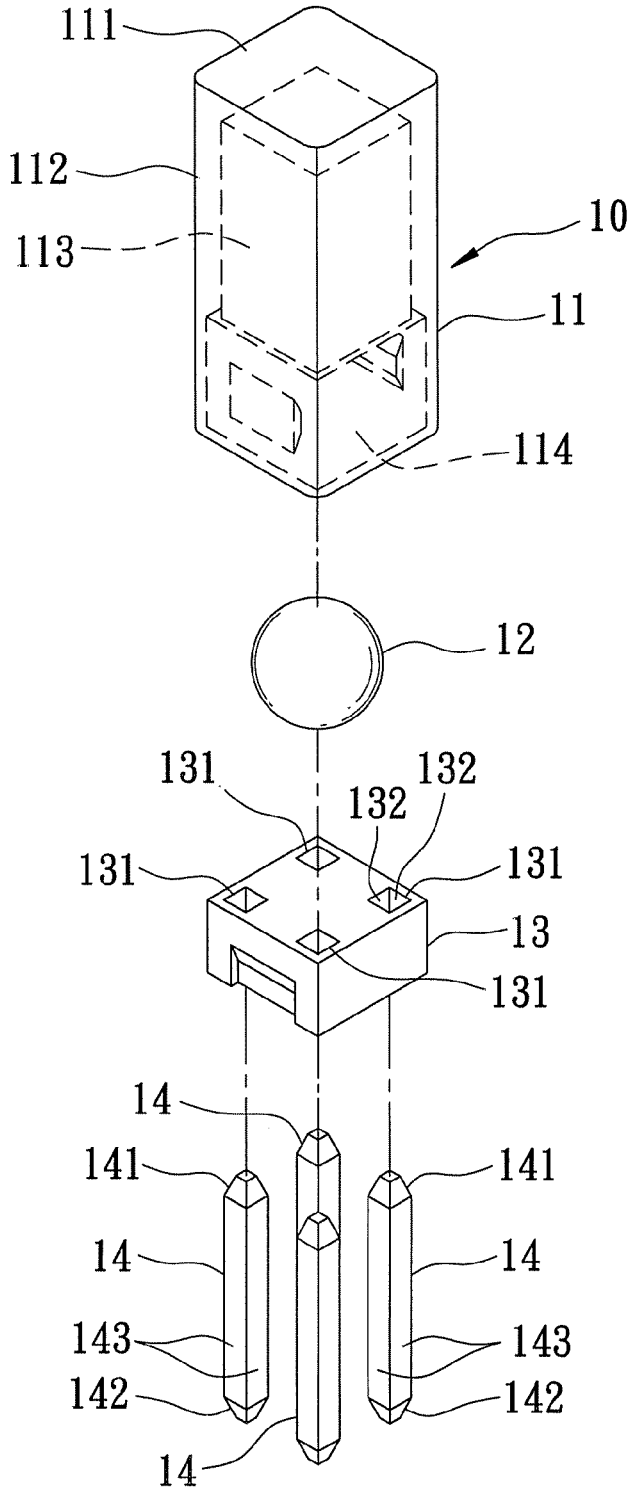
FIG. 1 PRIOR ART
FIG. 1 is an exploded perspective view of a conventional switch disclosed in Taiwanese Patent No. 155965.
Figure 2:
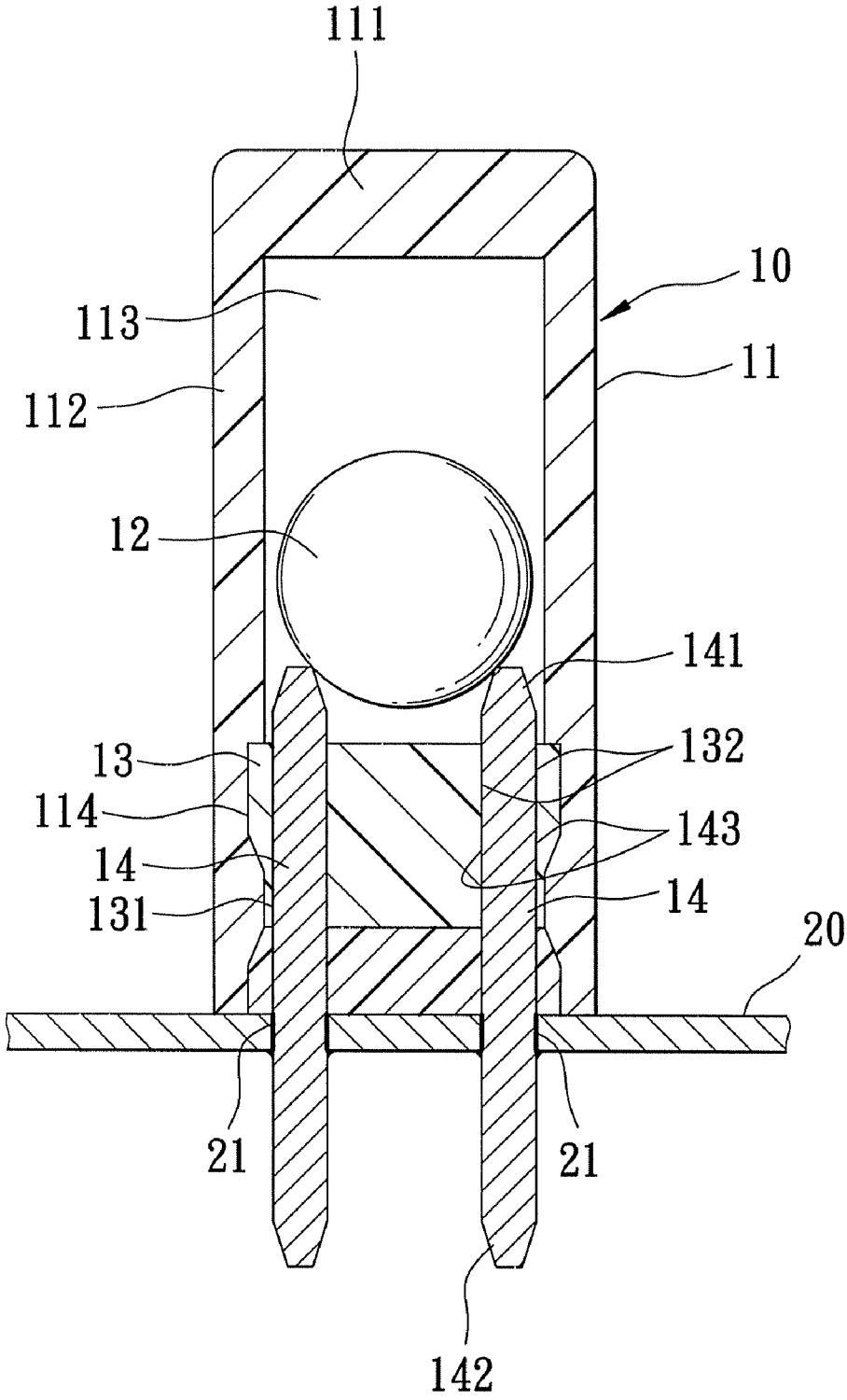
FIG. 2 PRIOR ART
FIG. 2 is an assembled sectional view of the conventional switch.
Figure 3:
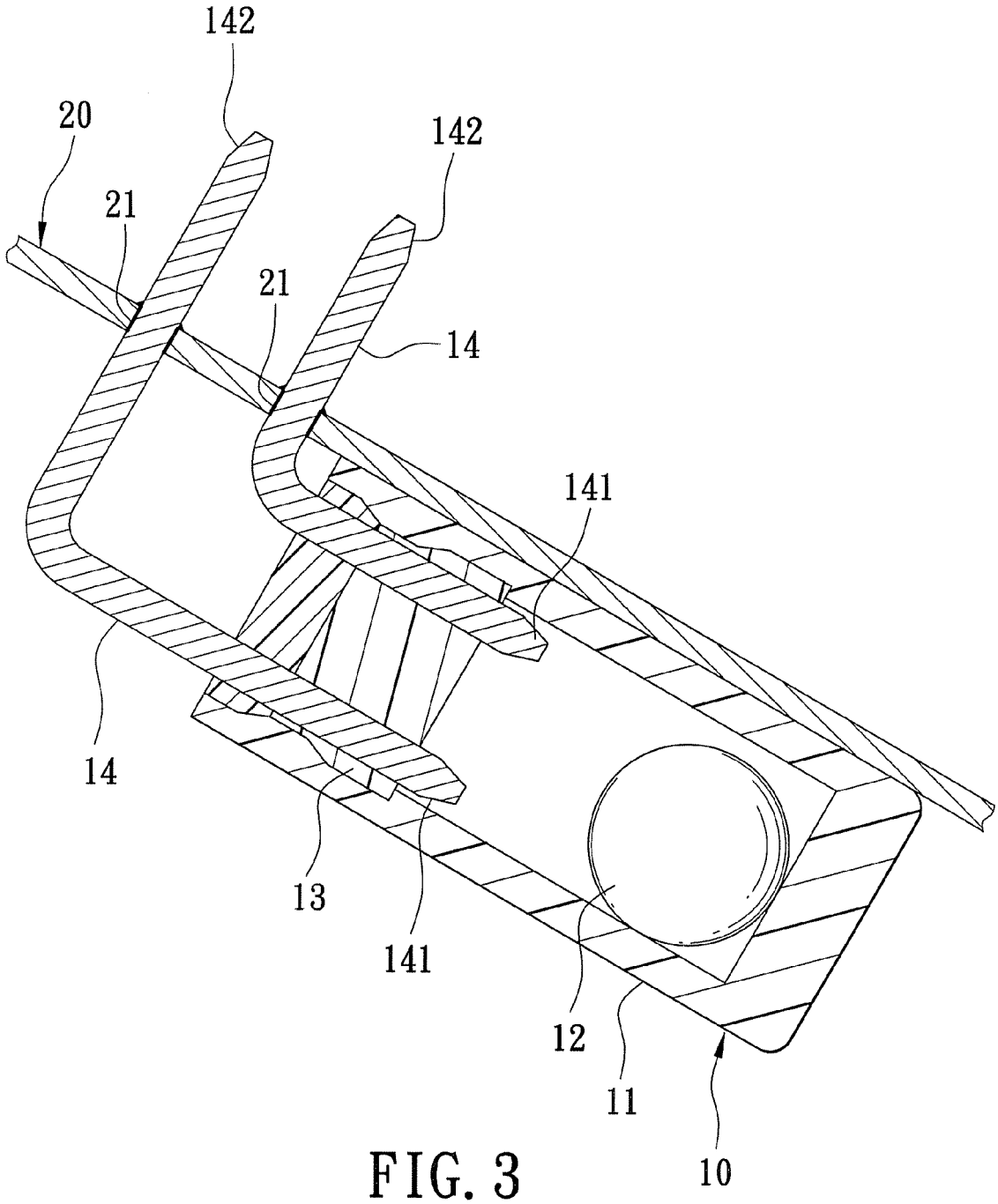
FIG. 3 PRIOR ART
FIG. 3 is a view similar to FIG. 2, but with the conventional switch mounted on a circuit board parallel to the same.
Figure 4:
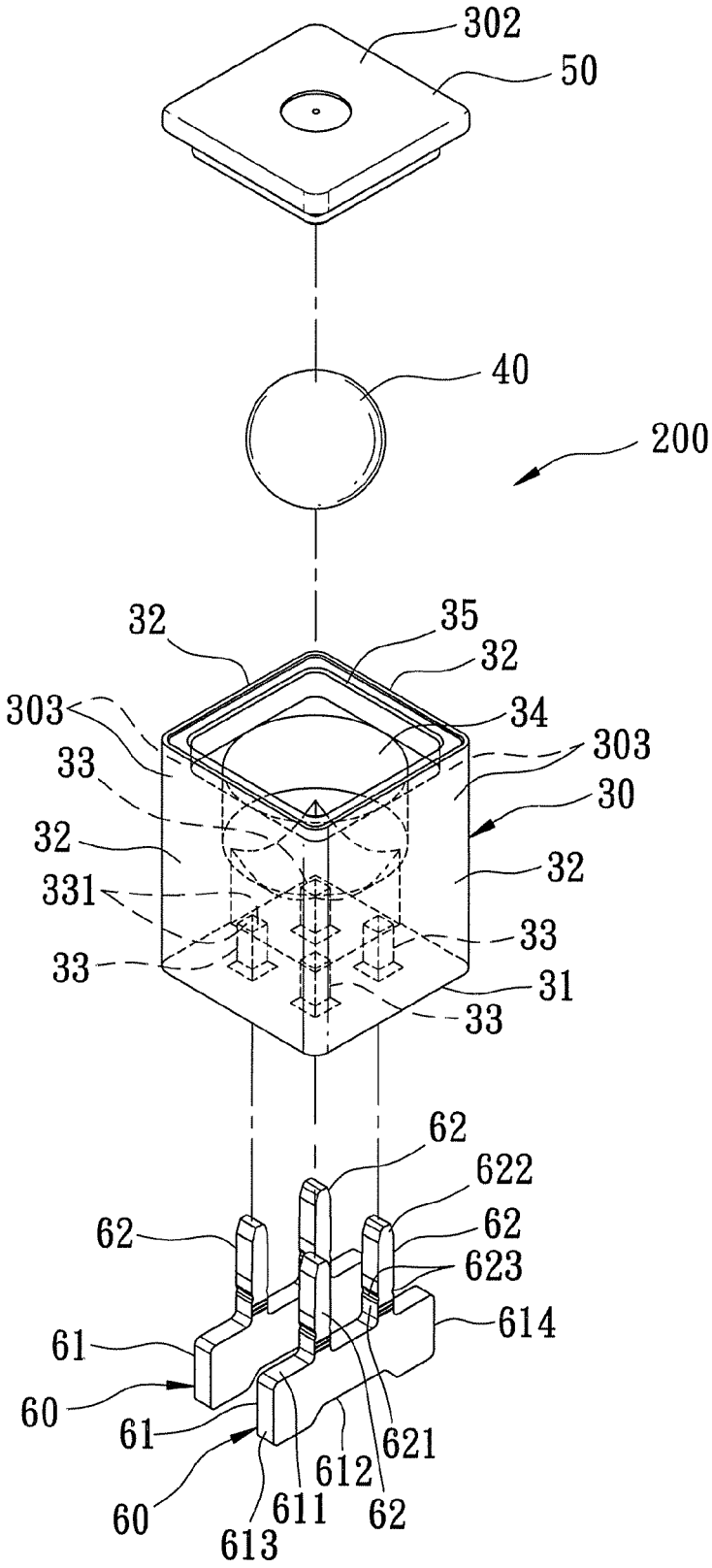
FIG. 4 is an exploded perspective view of the first preferred embodiment of a rolling-ball switch according to the present invention.

Before the present invention is described in greater detail, it should be noted that like elements are denoted by the same reference numerals throughout the disclosure.

Referring to FIGS. 4 to 10, the first preferred embodiment of a rolling-ball switch 200 according to the present invention is shown to comprise a housing 30, a conductive ball 40, and two conducting units 60.

The housing 30 is made of plastic, defines a chamber 34 having a top open end 35, and has a bottom wall 31, four interconnected side walls 32 extending upwardly from a peripheral end of the bottom wall 31, and a top cover 50 covering the top open end 35 of the chamber 34. The bottom wall 31 is formed with four spaced-apart through holes 33 arranged in a rectangular array. Each of the through holes 33 is defined by a four-sided hole wall 331.

The housing 30 further has a bottom face 301, a top face 302, and four lateral faces 303 interconnecting the bottom and top faces 301, 302. The bottom wall 31 has the bottom face 301, and is substantially perpendicular to the four lateral faces 303. The top cover 50 has the top face 302. The chamber 34 has a lower section 341 proximate to the bottom face 301, an upper section 342 having a cross-section larger than that of the lower section 341, and a tapering section 343 extending downward from the upper section 342 to the lower section 341.

The conducting units 60 respectively have plate-like connecting members 61 disposed in parallel below the bottom wall 31. Each of the connecting members 61 has an abutment surface 611 in abutment with the bottom face 301 of the housing 30, a first connecting surface 612 opposite to the abutment surface 611, and second and third connecting surfaces 613, 614 extending between and interconnecting the abutment surface 611 and the first connecting surface 612. The distance between the second and third connecting surfaces 613, 614 may be larger than or equal to the distance between two opposite ones of the side walls 32 of the housing 30. In this embodiment, the first connecting surface 612 has a cutout part to facilitate checking of the soldering condition of the first connecting surface 612 to a circuit board 100.

Each of the conducting units 60 further includes two terminals 62 extending upwardly from the abutment surface 611 of the corresponding connecting member 61 into the chamber 34 via the corresponding through holes 33 in the bottom wall 31 of the housing 30. The two terminals 62 are spaced apart from each other in a longitudinal direction of the corresponding connecting member 61. The second and third surfaces 613, 614 of each connecting member 61 are opposite to each other in the longitudinal direction, and are adapted to be selectively fixed on the circuit board 100.

Figure 7:
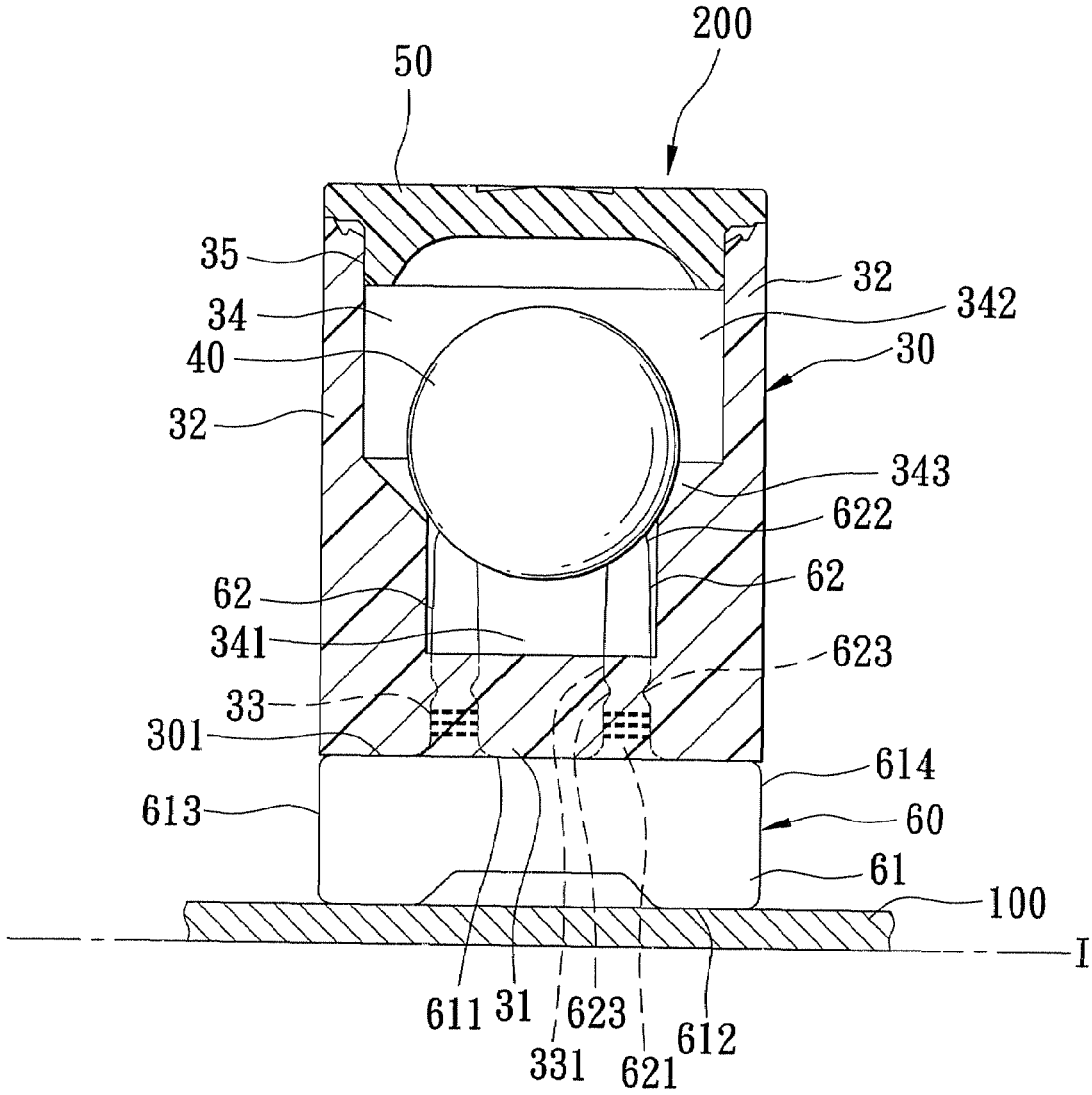
FIG. 7 is a sectional view of the first preferred embodiment taken along line 7-7 of FIG. 5.
Figure 9:
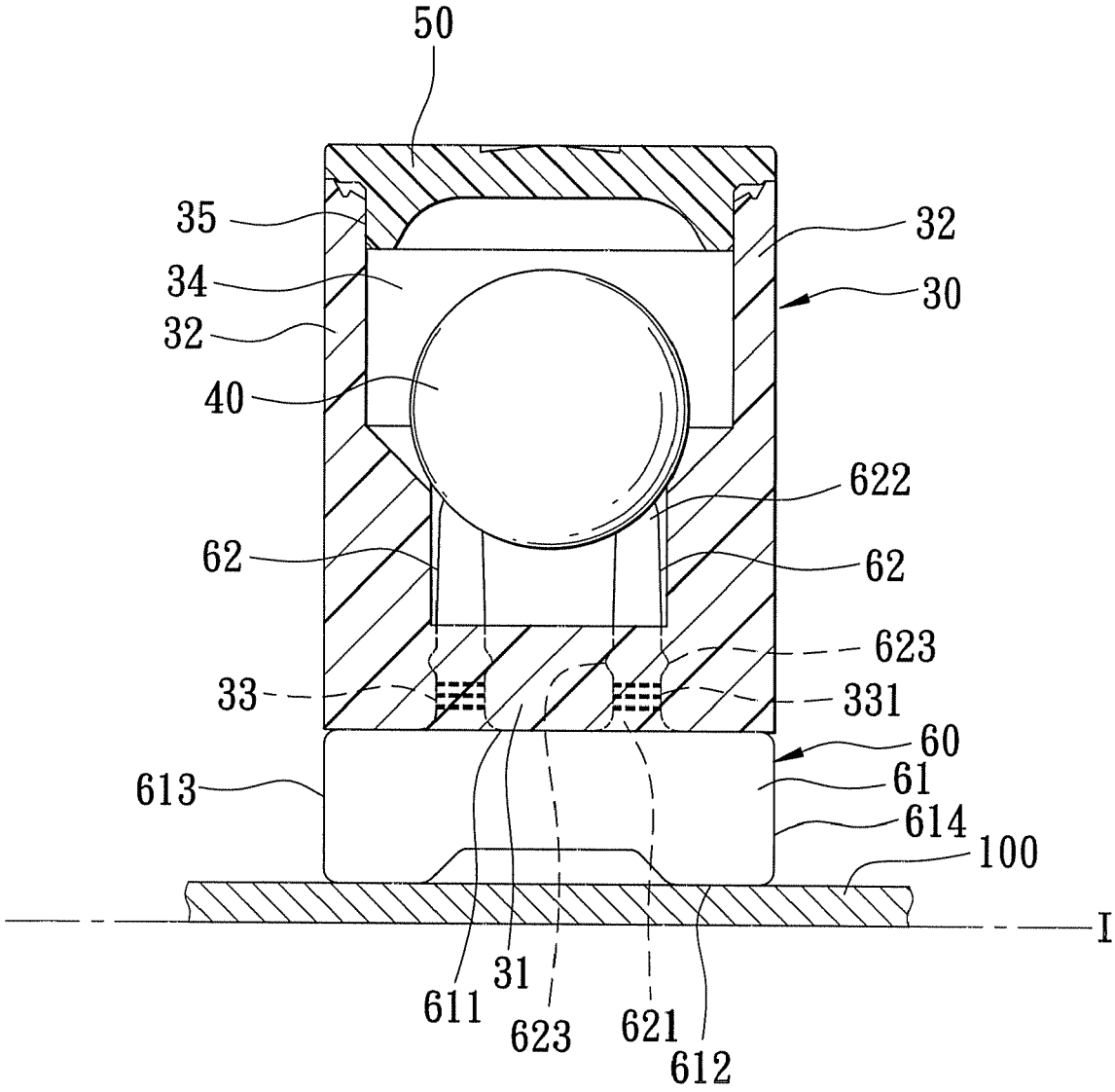
FIG. 9 is a view similar to FIG. 7, but with an alternative form of engaging members of terminals of conducting units.

Each of the terminals 62 includes an insert section 621 extending upwardly from the abutment surface 611 of the corresponding connecting member 61 and inserted into the corresponding through hole 33, a contact section 622 extending from the insert section 621 into the chamber 34, and an engaging member 623 provided on four sides of the insert section 621 and engaging the hole wall 331 of the corresponding through hole 33. The contact sections 622 of the terminals 62 are provided with substantially the same height, and extend into the tapering section 343 of the chamber 34. The engaging member 623 may be configured as an indentation, as shown in FIG. 7, or as a protrusion, as shown in FIG. 9.

The conducting units 60 are made by stamping, and have similar dimensions. A jig (not shown) is used to insert the terminals 62 of the conducting units 60 into the respective through holes 33 in the bottom wall 31 of the housing 30 until the abutment surface 611 of each conducting unit 60 abuts against the bottom wall 31 or the bottom face 301 of the housing 30. Hence, not only is assembly of the conducting units 60 and the housing 30 relatively easy, the lengths of the terminals 62 that extend into the chamber 34 can be easily and accurately controlled as well.

The conductive ball 40 is disposed in the chamber 34, and is movable toward or away from the contact sections 622 of the terminals 62. The conductive ball 40 is limited to move within the chamber 34 through engagement of the cover body 50 with top ends of the side walls 32 of the housing 30 so as to close the top open end 35 of the chamber 34.

Figure 5:
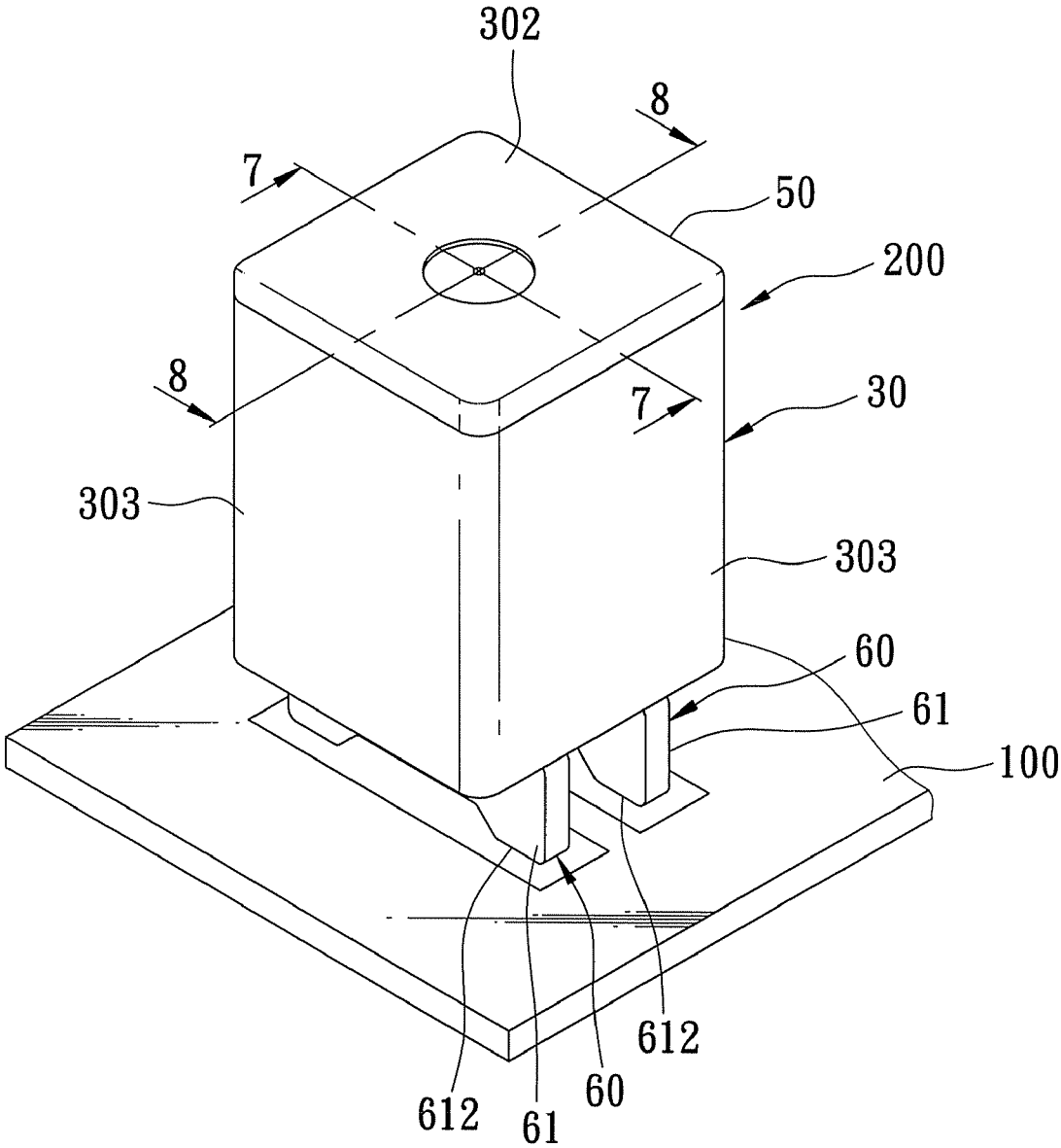
FIG. 5 is an assembled perspective view of the first preferred embodiment with the rolling-ball switch of the present invention mounted upright on a circuit board.

After assembly of the switch 200, the user may proceed with the soldering process in a manner that suits his/her particular requirements. With reference to FIG. 5, the user may employ surface mount technology to fix the first connecting surfaces 612 of the connecting members 61 of the conducting units 60 to the circuit board 100. The first connecting surfaces 612 of the connecting members 61 are substantially parallel to the bottom face 301 of the housing 30. Therefore, the four lateral faces 303 of the housing 30 are substantially perpendicular to the circuit board 100. In other words, the switch 200 is perpendicular to the circuit board 100.

Figure 6:
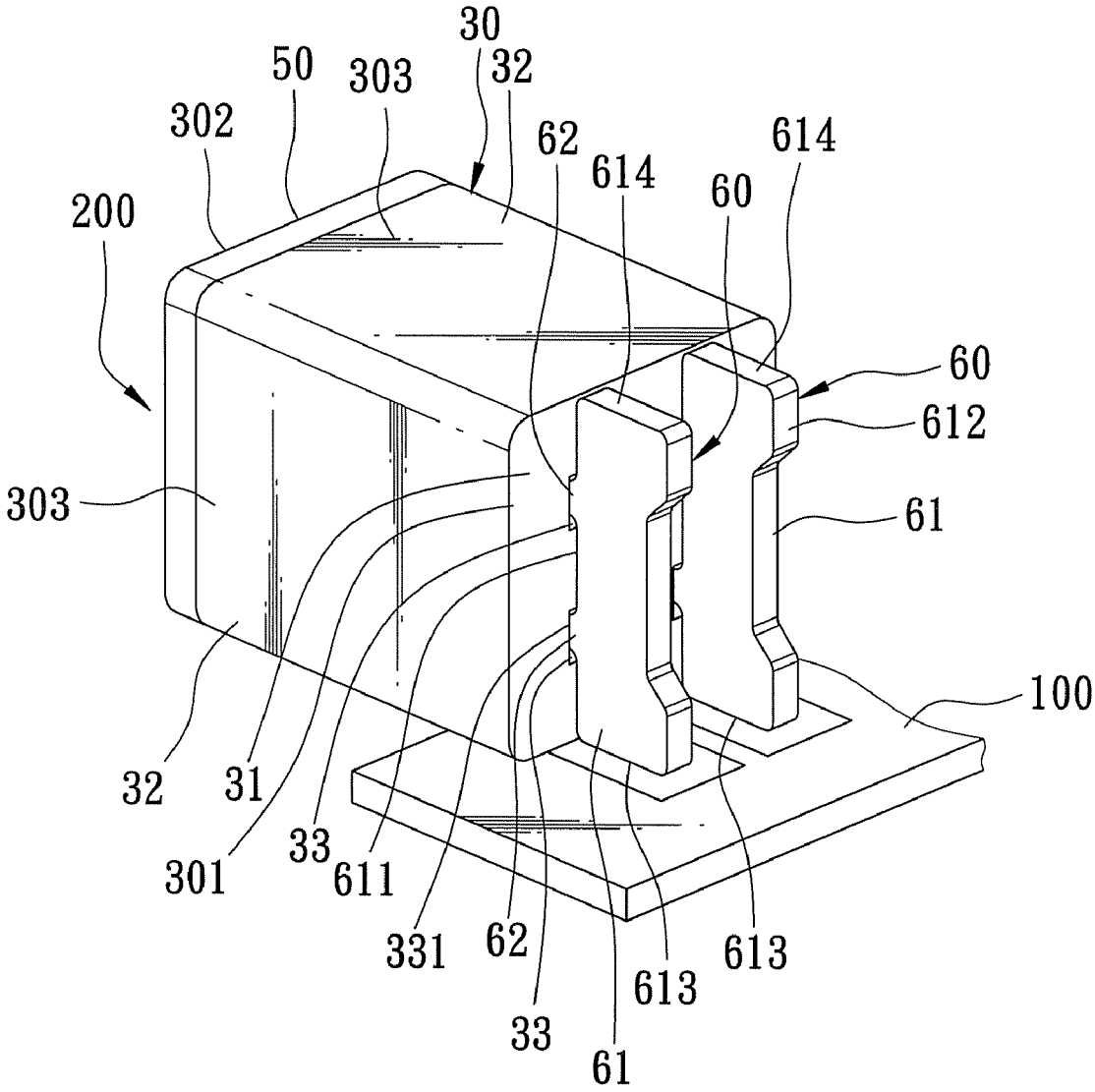
FIG. 6 is a view similar to FIG. 5, but with the rolling-ball switch of the present invention mounted on the circuit board parallel to the same.

With reference to FIG. 6, the user may also employ surface mount technology to fix the second connecting surfaces 613 of the connecting members 61 of the conducting units 60 to the circuit board 100 as needed. The second connecting surfaces 613 of the connecting members 61 are substantially perpendicular to the bottom face 301 of the housing 30, and extend substantially in the same direction as an adjacent one of the four lateral faces 303 of the housing 30. Therefore, this adjacent one of the four lateral faces 303 is substantially parallel to the circuit board 100. In other words, the switch 200 is parallel to the circuit board 100.

Figure 8:
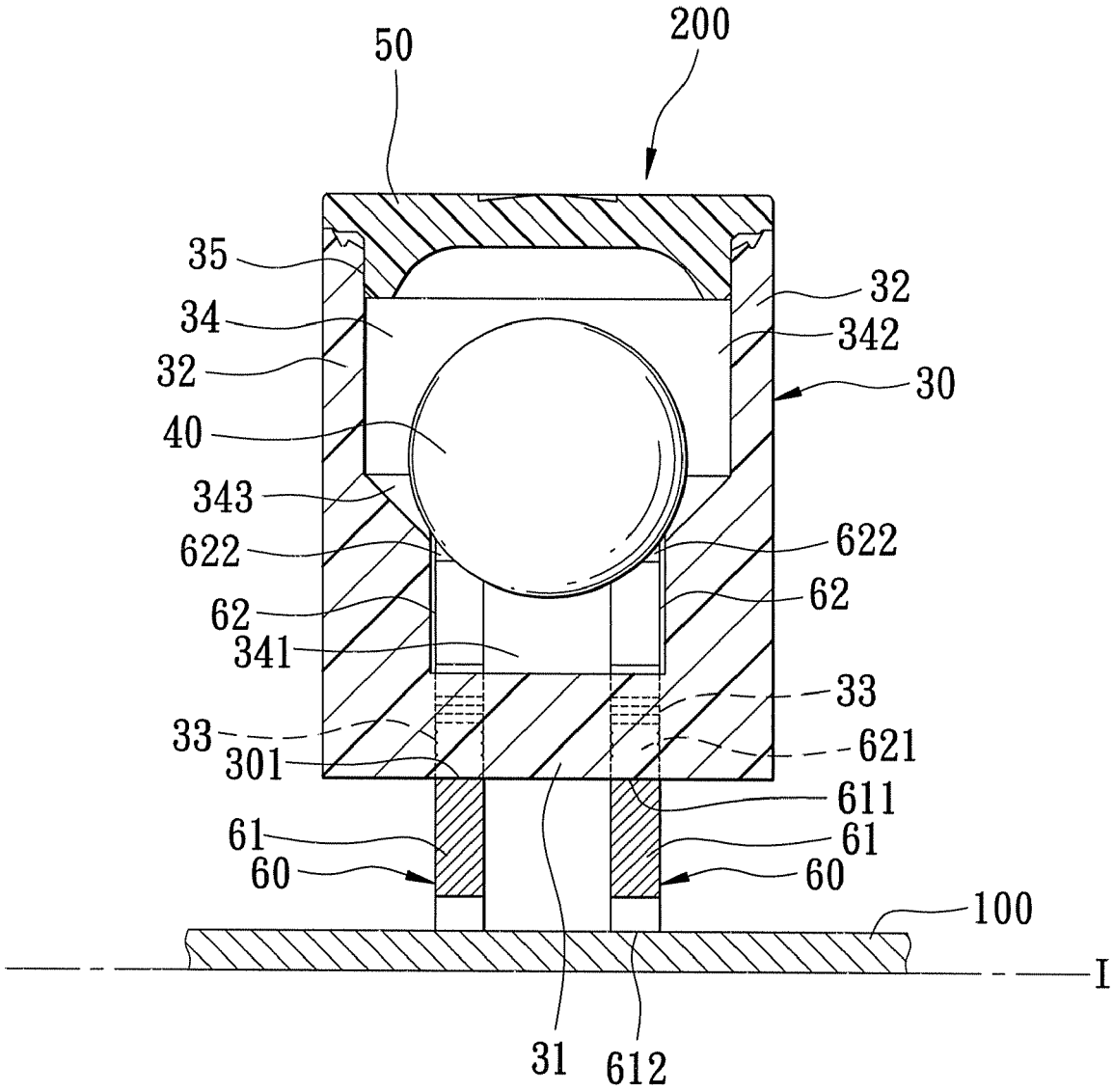
FIG. 8 is a sectional view of the first preferred embodiment taken along line 8-8 of FIG. 5.

In use, with reference to FIGS. 7 and 8, when the circuit board 100 is parallel to a reference horizontal surface (I), i.e., an operating surface for an electronic product (not shown) to which the switch 200 and the circuit board 100 are attached, the conductive ball 40 is maintained in contact with the contact sections 622 of the terminals 62. Hence, the switch 200 is in an "ON" state when the switch 200 is in a vertical position with respect to the reference horizontal surface (I) and is perpendicular to the circuit board 100.

Figure 10:
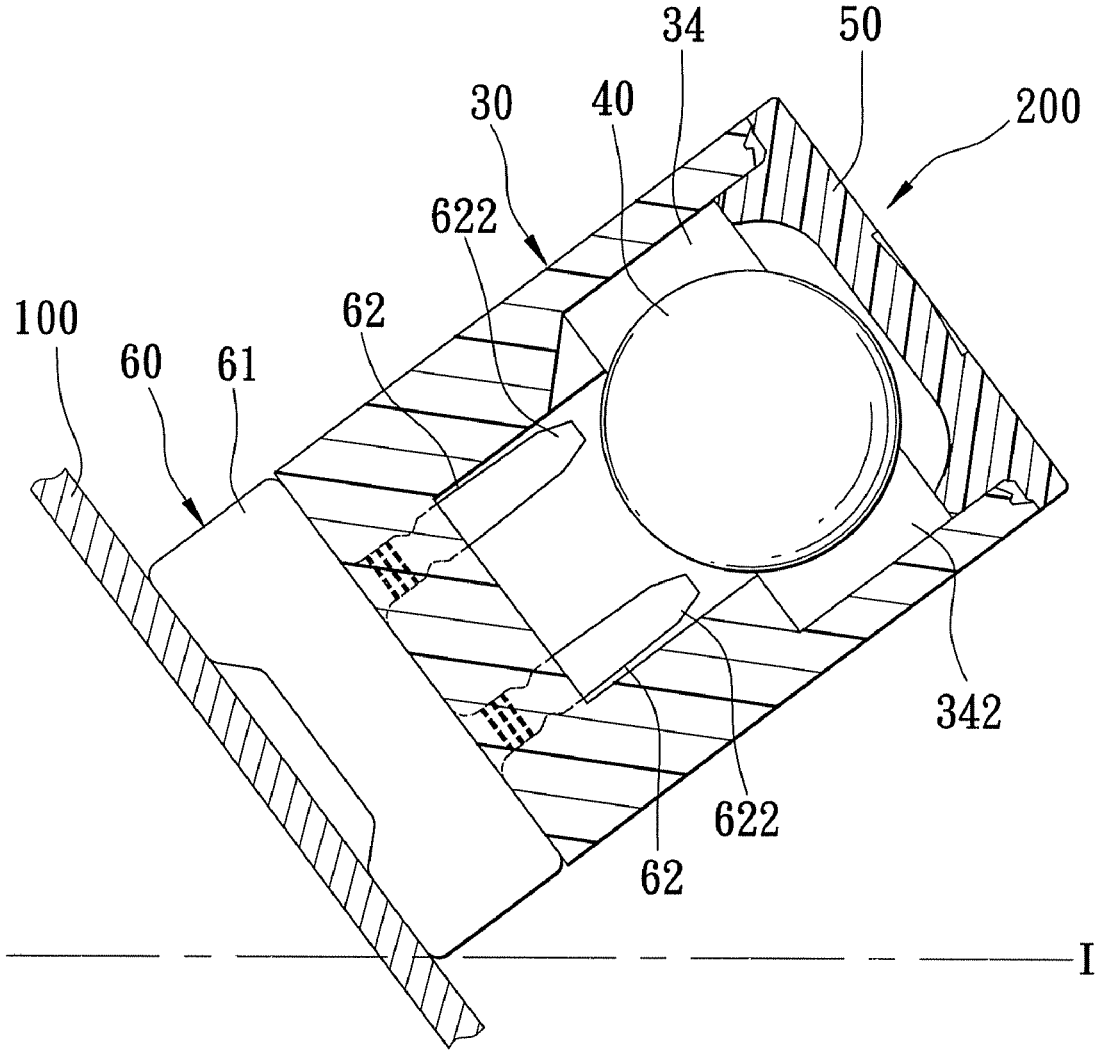
FIG. 10 is a view similar to FIG. 7, but with a conductive ball rolled away from the terminals of the conducting units so as to place the rolling-ball switch of the present invention in an OFF state.
Figure 11:
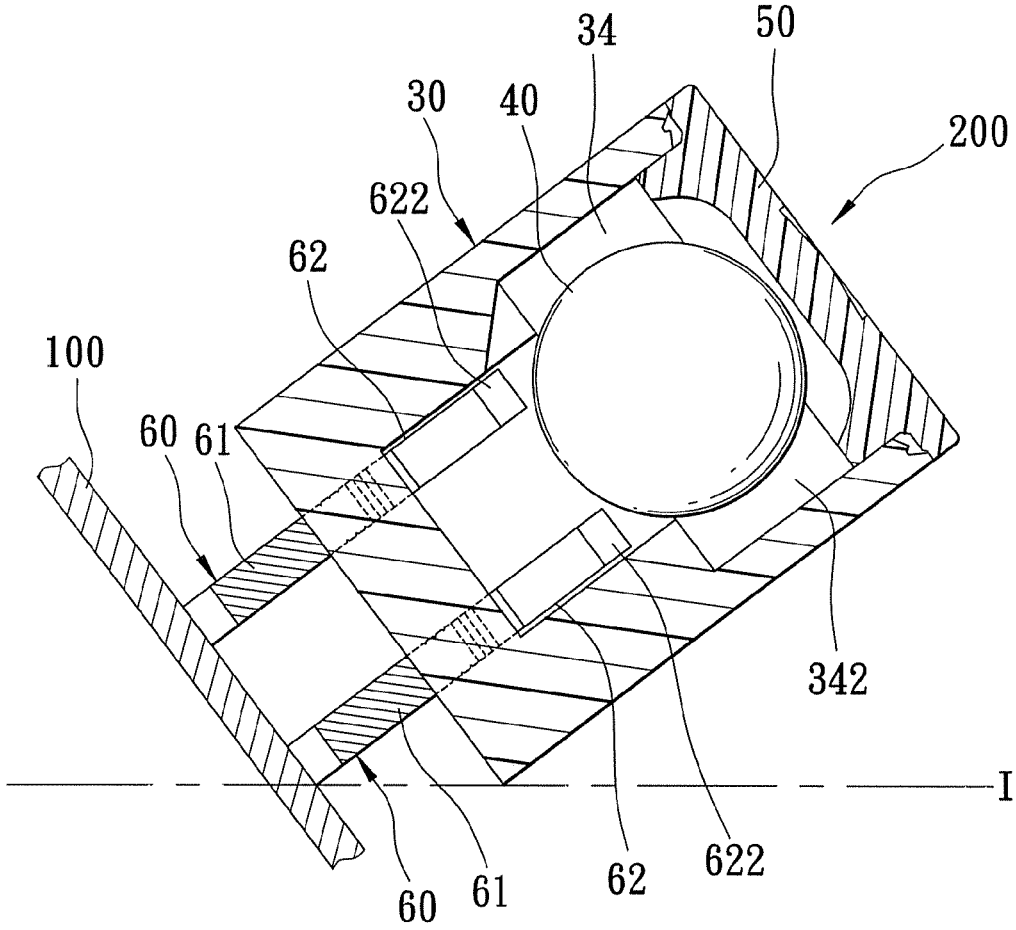
FIG. 11 is a view similar to FIG. 8, but with the rolling-ball switch of the present invention in the OFF state.

With reference to FIGS. 10 and 11, when the circuit board 100 is inclined with respect to the reference horizontal surface (I), the conductive ball 40 rolls away from the contact sections 622 of the terminals 62 toward the upper section 342 of the chamber 34 so as to switch the switch 200 from the "ON" state to an "OFF" state. The switch 200 is inclined with respect to the reference horizontal surface (I) in this state.

Figure 12:
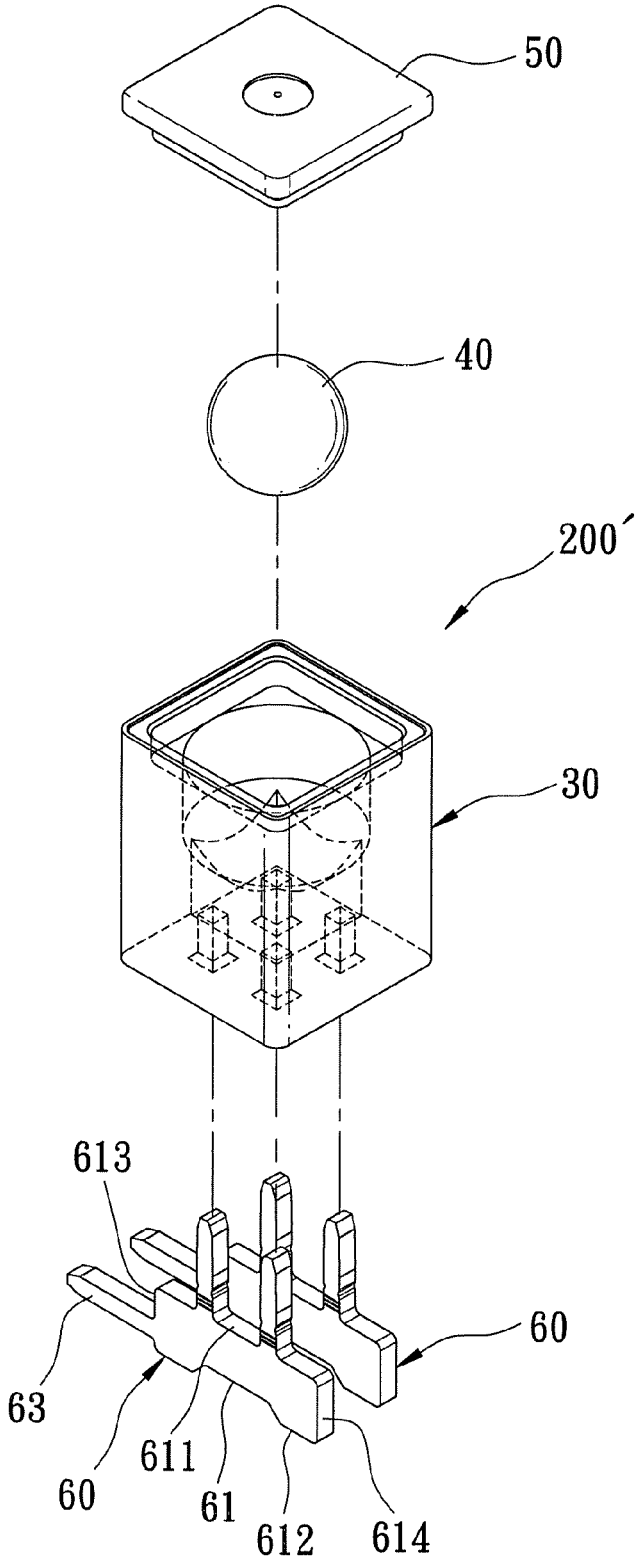
FIG. 12 is a view similar to FIG. 4, but illustrating an alternative form of the conducting units.
Figure 13:
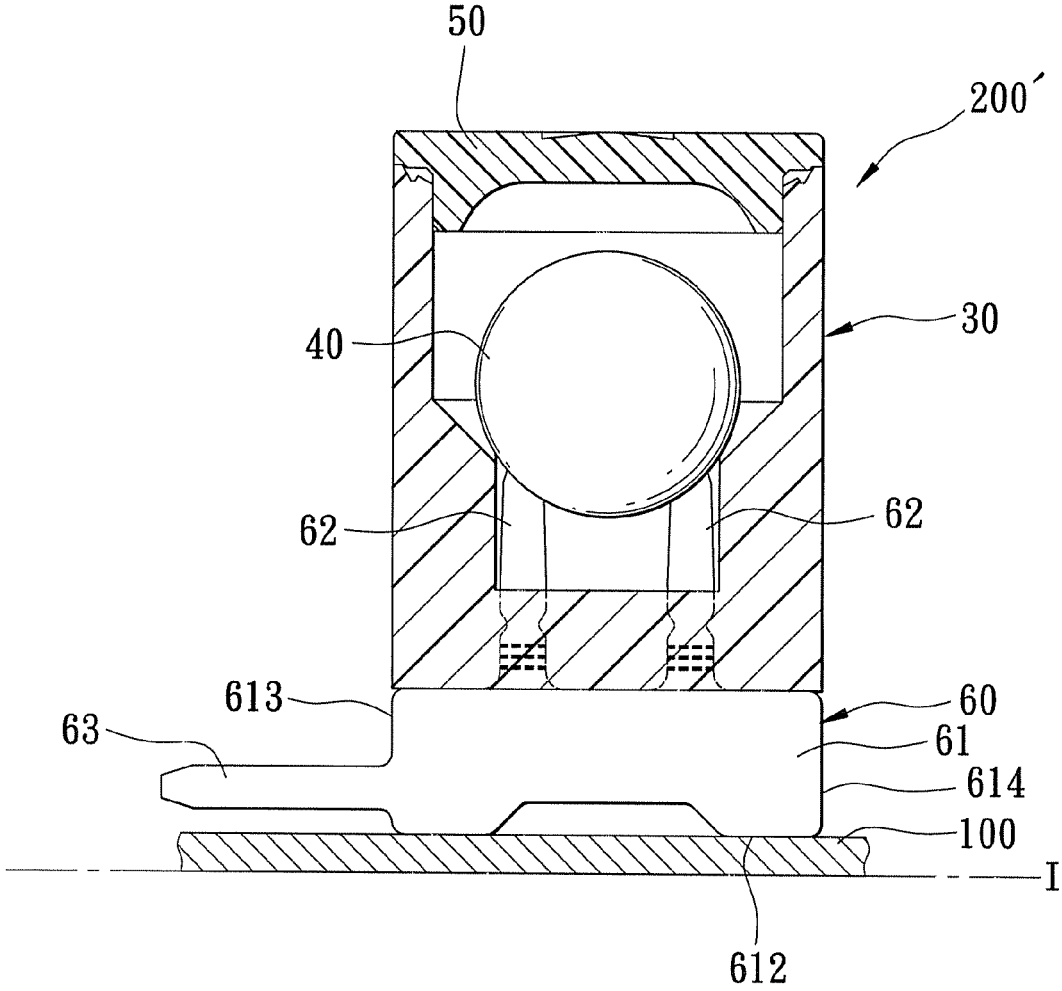
FIG. 13 is an assembled sectional view of FIG. 12 in a state of use.
Figure 14:
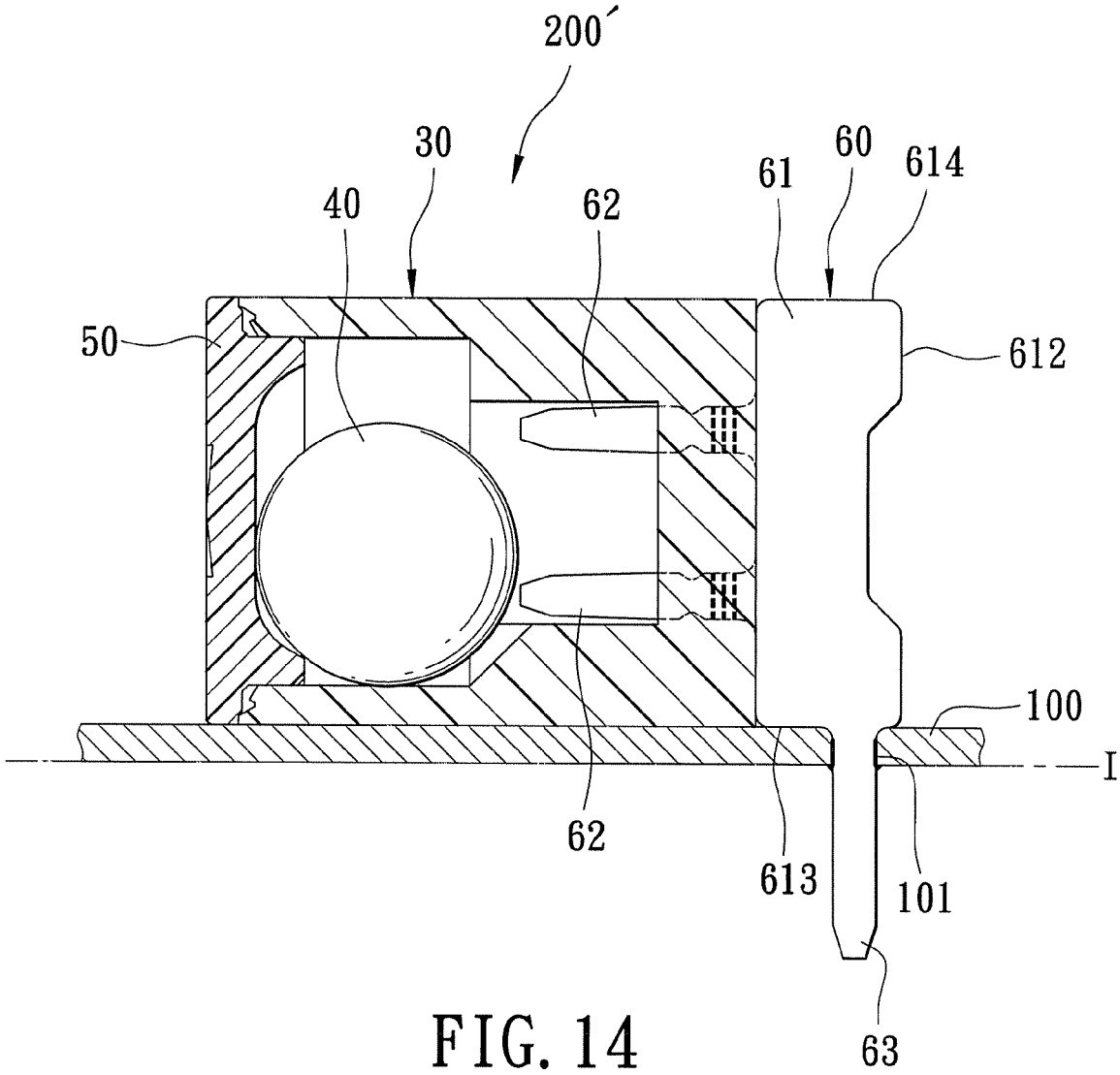
FIG. 14 is a view similar to FIG. 13, but with the rolling-ball switch of the present invention mounted on the circuit board parallel to the same.

With reference to FIGS. 12 to 14, each of the conducting units 60 of the switch 200' may further include a connecting leg 63 that extends outwardly from the second connecting surface 613 of the corresponding conducting unit 60 and that is adapted to be inserted into the circuit board 100. Alternatively, the connecting leg 63 may extend outwardly from the third connecting surface 614. In FIG. 13, the first connecting surface 612 of the connecting member 61 of each conducting unit 60 is fixed to the circuit board 100 utilizing surface mount technology so that the switch 200' is in an "ON" state when it is vertical with respect to the reference horizontal surface (I). In FIG. 14, the connecting leg 63 of each conducting unit 60 is inserted into an insert hole 101 in the circuit board 100 until the second connecting surface 613 abuts against the circuit board 100. Afterwards, the connecting legs 63 of the conducting units 60 are soldered fixedly to the circuit board 100. With this mounting configuration, the switch 200' is in an "OFF" state when it is horizontal with respect to the reference horizontal surface (I) and the circuit board 100.

Figure 15:
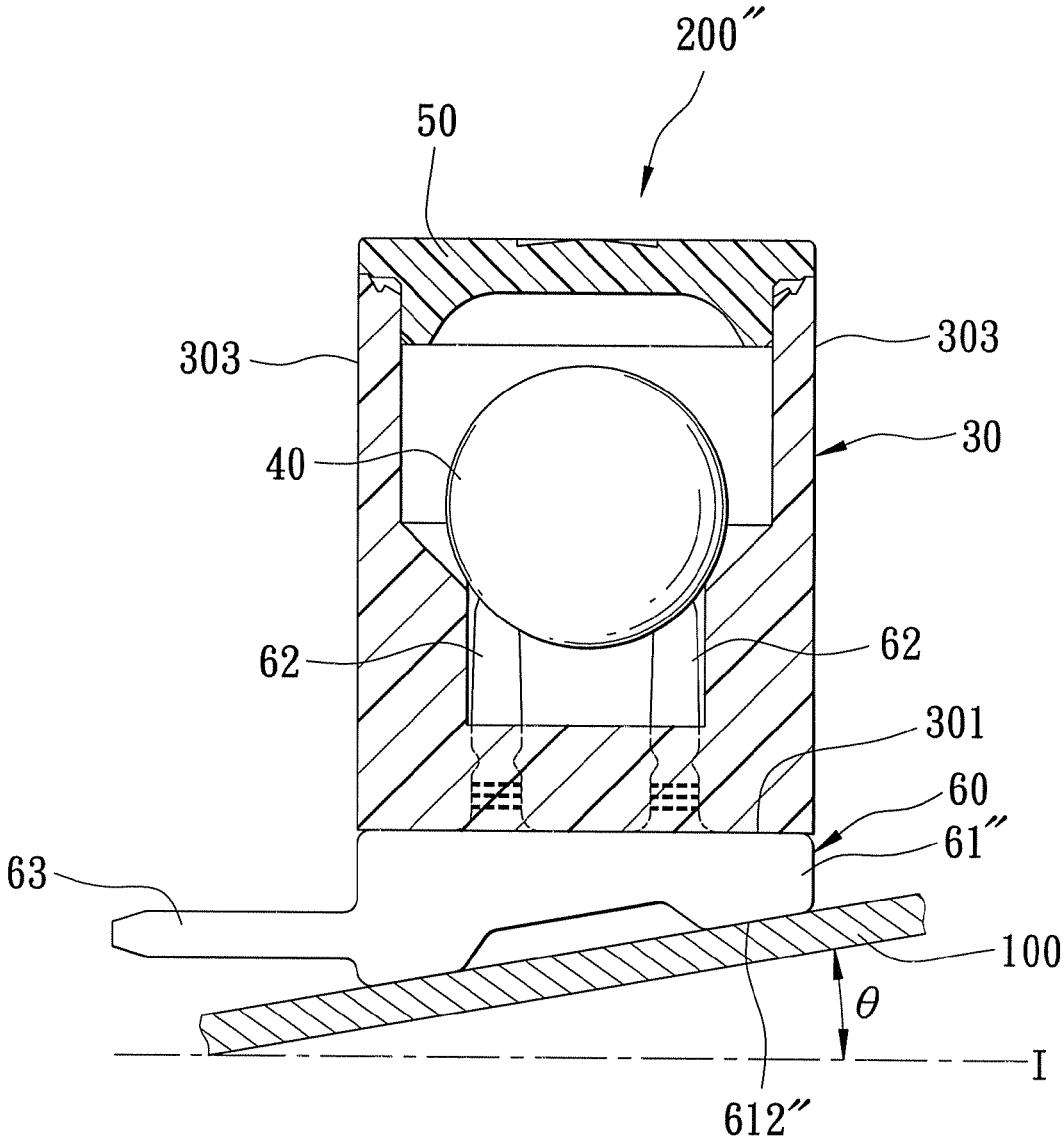
FIG. 15 is a view similar to FIG. 13, but with first connecting surfaces of connecting members of the conducting units being oblique to a bottom face of a housing of the rolling-ball switch of the present invention.

With reference to FIG. 15, when the circuit board 100 is mounted inclinedly on an electronic product (not shown), the circuit board 100 will be inclined with respect to the reference horizontal surface (I) at an angle θ. At this time, the first connecting surface 612" of each connecting member 61" can be arranged to be oblique to the bottom face 301 of the housing 30 during stamping of the conducting units 60 so that the four lateral faces 303 of the housing 30 are inclined with respect to the circuit board 100. Hence, when the first connecting surface 612" of each connecting member 61" is fixed to the circuit board 100, the switch 200" is in an "ON" state when it is vertical with respect to the reference horizontal surface (I).

Figure 16:
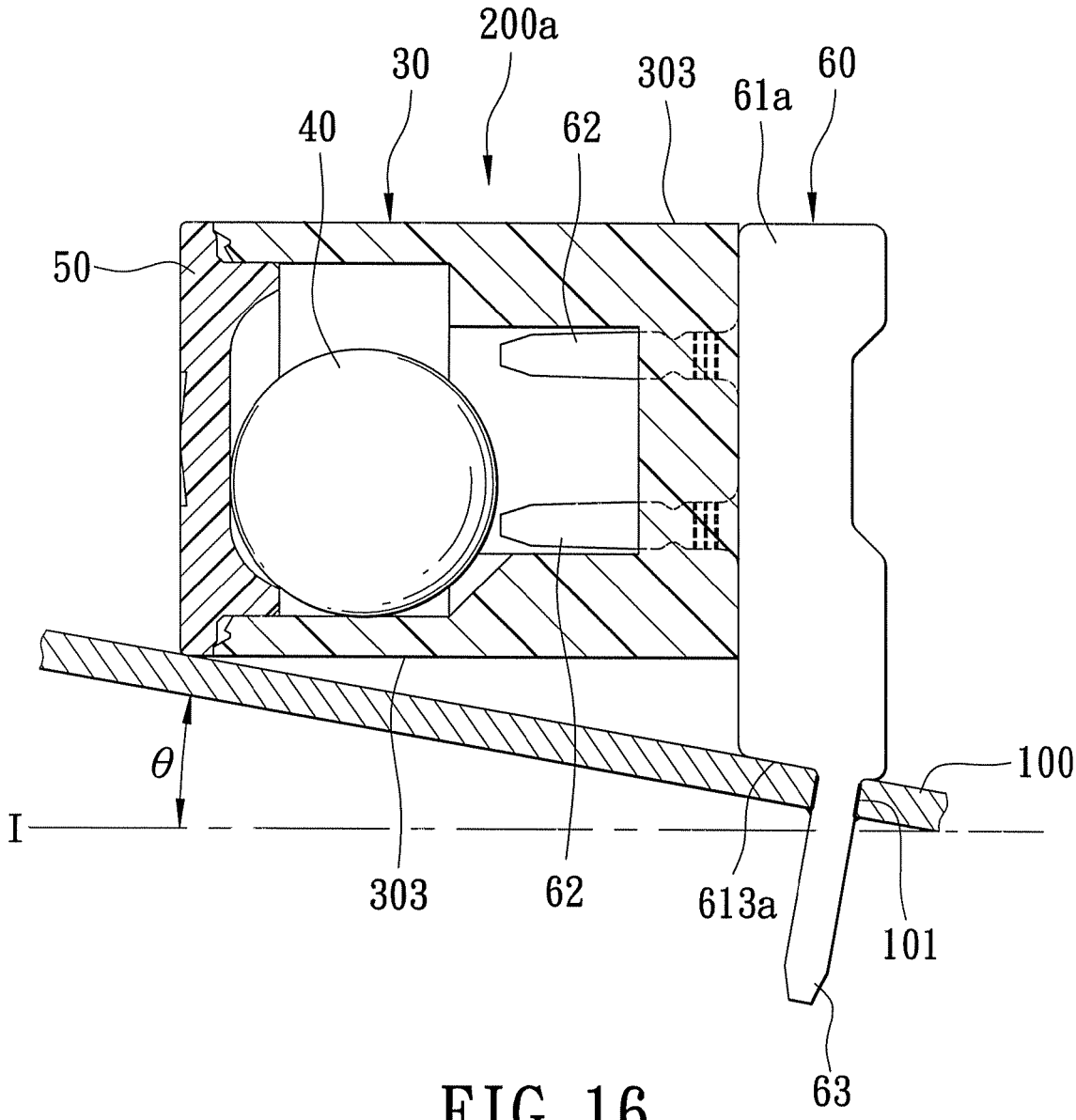
FIG. 16 is a view similar to FIG. 13, but with second connecting surfaces of the connecting members of the conducting units being oblique to an adjacent one of lateral faces of the housing of the rolling-ball switch of the present invention.

With reference to FIG. 16, the second connecting surface (613*a*) of each connecting member (61*a*) may alternatively be arranged to extend in a plane oblique to an adjacent one of the four lateral faces 303 of the housing 30 so that the adjacent lateral face 303 is inclined with respect to the circuit board 100. Hence, when the connecting leg 63 of each conducting unit 60 is inserted into the corresponding insert hole 101 in the circuit board 100 until the second connecting surface (613*a*) of each connecting member (61*a*) abuts against the circuit board 100, the switch (200*a*) can be maintained in an "OFF" state when it is horizontal with respect to the reference horizontal surface (I). The top cover 50 abuts against the circuit board 100 at this time so as to form a support point. The connecting leg 63 is then soldered fixedly to the circuit board 100.

Figure 17:
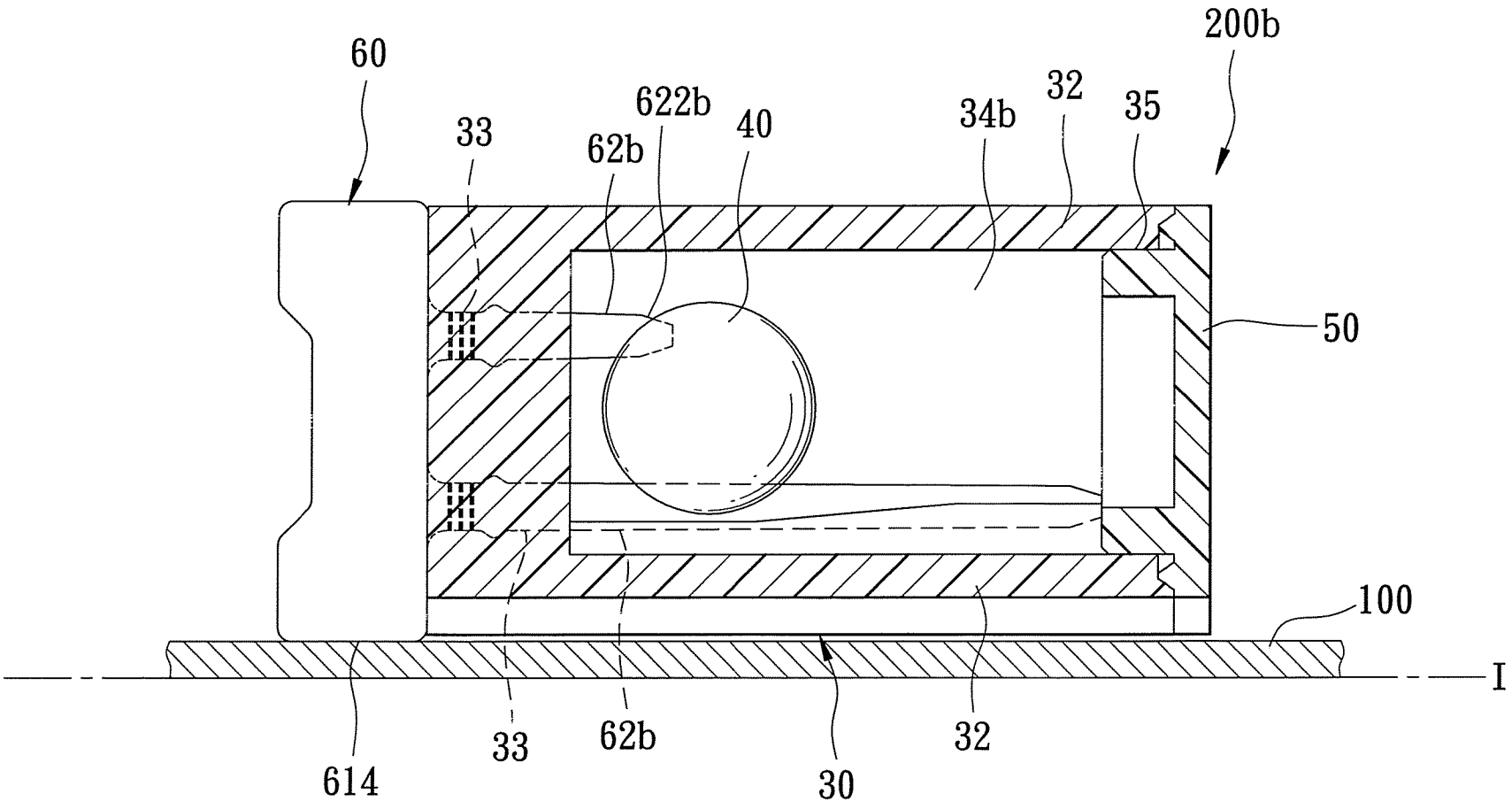
FIG. 17 is a sectional view of the second preferred embodiment of a rolling-ball switch according to the present invention.

With reference to FIG. 17, according to a second embodiment of the present invention, the chamber (34*b*) has substantially the same cross-sectional shape from top to bottom ends. Two of the terminals (62*b*) of the conducting units 60 of the switch (200*b*) have long lengths, while the other two of the terminals (62*b*) of the conducting units 60 have short lengths and contact sections (622*b*). The third connecting surface 614 is fixed to the circuit board 100 so that the switch (200*b*) is horizontal with respect to the reference horizontal surface (I) and the circuit board 100. The conductive ball 40 is in rolling contact with the terminals (62*b*) having the long lengths while moving toward or away from the contact sections (622*b*) of the terminals (62*b*) having the short lengths. When the conductive ball 40 moves to the contact sections (622*b*), the switch (200*b*) is in an "ON" state. The different configuration of the terminals (62*b*) permits a different use of the switch (200*b*).

Figure 18:
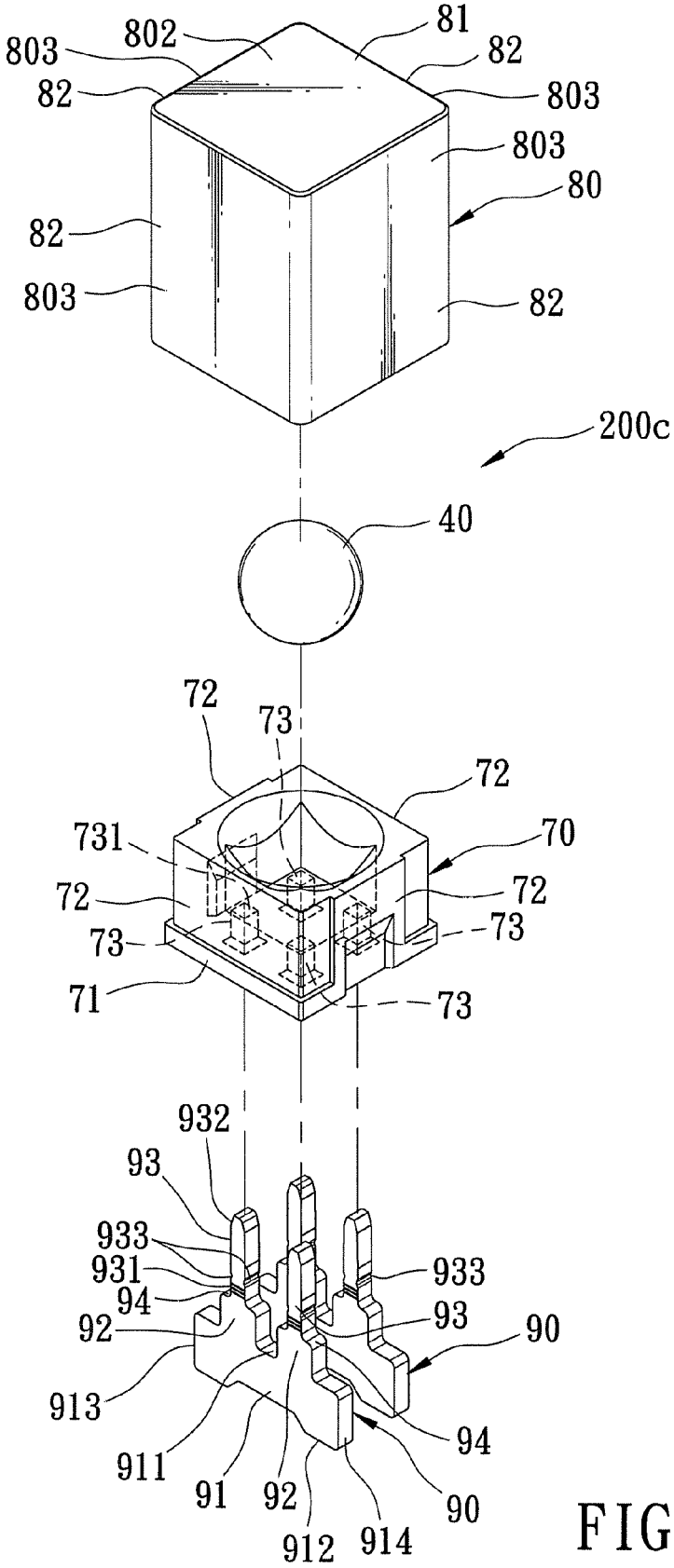
FIG. 18 is an exploded perspective view of the third preferred embodiment of a rolling-ball switch according to the present invention.
Figure 19:
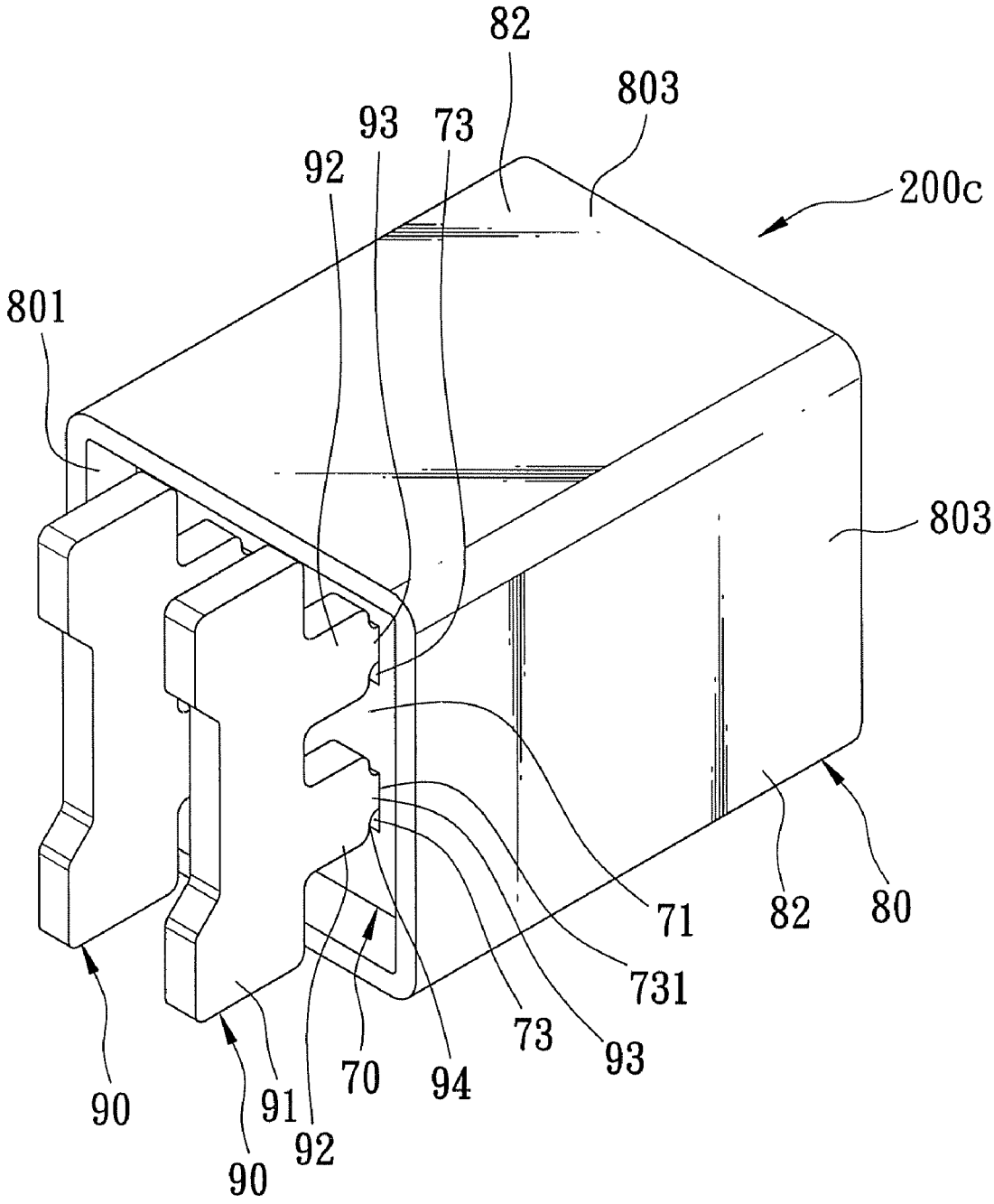
FIG. 19 is an assembled perspective view of the third preferred embodiment.
Figure 20:
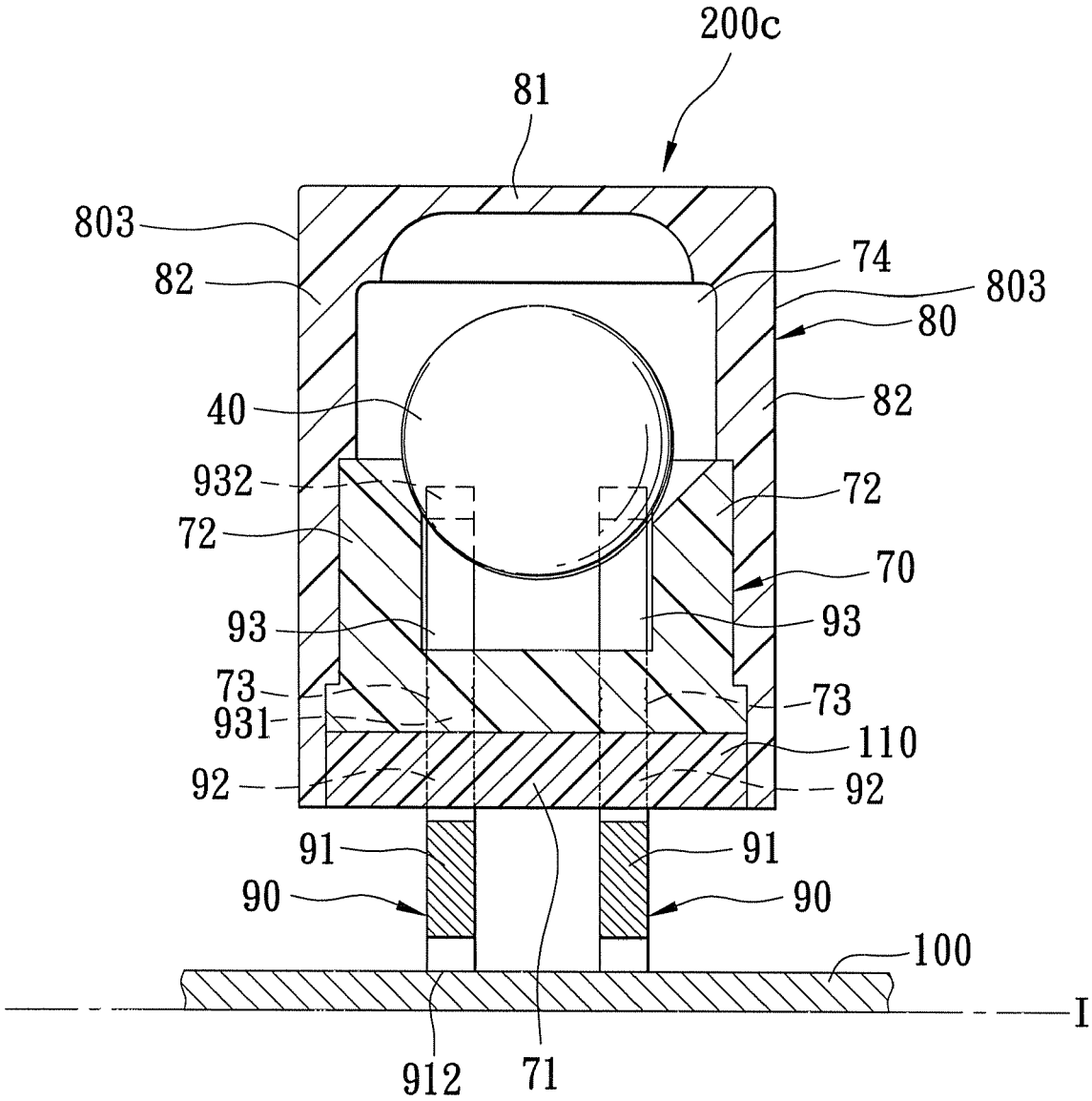
FIG. 20 is an assembled sectional view of the third preferred embodiment with the rolling-ball switch of the present invention in an ON state.

Referring to FIGS. 18 to 20, the third preferred embodiment of a switch (200*c*) according to the present invention is shown to comprise a housing, two conducting units 90, and a conductive ball 40.

The housing includes a bottom seat 70 and a cover body 80. The bottom seat 70 has a bottom wall 71, and four interconnected lower side walls 72 extending upwardly from a peripheral end of the bottom wall 71. The bottom wall 71 is formed with four spaced-apart through holes 73. Each of the through holes 73 is defined by a four-sided hole wall 731.

The cover body 80 has a top wall 81, and four interconnected upper side walls 82 extending downwardly from a peripheral end of the top wall 81 and surrounding the lower side walls 72 beyond the bottom wall 71. The top and bottom walls 81, 71 and the upper and lower side walls 82, 72 cooperatively define a chamber 74.

The housing further has a bottom face 801, a top face 802, and four lateral faces 803 interconnecting the bottom and top faces 801, 802. The bottom wall 71 has the bottom face 801. The upper side walls 82 respectively have the lateral faces 803. The top wall 81 has the top face 802.

The conducting units 90 are similar to the conducting units 60 of the first preferred embodiment. Particularly, the conducting units 90 respectively have plate-like connecting members 91 disposed in parallel below the bottom wall 71. Each connecting member 91 has first, second, and third connecting surfaces 912, 913, 914. However, in this embodiment, each of the connecting members 91 further has a fourth surface 911 opposite to the first connecting surface 912, and two spaced-apart upward protrusions 92 extending upwardly from the fourth surface 911. Each of the upward protrusions 92 has an abutment surface 94.

Each of the conducting units 90 further includes two terminals 93 extending upwardly and respectively from the abutment surfaces 94 of the upward protrusions 92. Each terminal 93 includes an insert section 931 extending upwardly from the abutment surface 94 of the corresponding upward protrusion 92 and inserted into the corresponding through hole 73, a contact section 932 extending from the insert section 931 into the chamber 74, and an engaging member 933 provided on four sides of the insert section 931 and engaging the hole wall 731 of the corresponding through hole 73.

The conductive ball 40 is disposed in the chamber 74, and is movable toward or away from the contact sections 932 of the terminals 93.

After the conductive ball 40 is confined within the chamber 74, the terminals 93 of the conducting units 90 are inserted interferentially into the corresponding through holes 73 through the use of a jig (not shown) until the abutment surface 94 of each upward protrusion 92 abuts against the bottom wall 71 (i.e., the bottom face 801 of the housing). A resin is then injected into a space defined by the upper side walls 82, the bottom wall 71 (i.e., the bottom face 801 of the housing), and the fourth surfaces 911 of the connecting members 91. As a result, a sealing member 110 is formed within the upper side walls 82 and between the bottom face 801 of the housing and the fourth surfaces 911 of the connecting members 91 after the resin is cured. The protrusions 92 of the connecting members 91 are embedded within the sealing member 110 at this time.

Like the first preferred embodiment, the user may choose to fix the first, second or third connecting surfaces 912, 913, 914 of the conducting units 90 to the circuit board 100 using surface mount technology as needed.

With reference to FIG. 20, when the first connecting surfaces 912 of the conducting units 90 are fixed to the circuit board 100 and the circuit board 100 is parallel to the reference horizontal surface (I), the conductive ball 40 is maintained in contact with the contact sections 932 of the terminals 93, so that the switch (200*c*) is maintained in an "ON" state when it is vertical to the reference horizontal surface (I).

Figure 21:
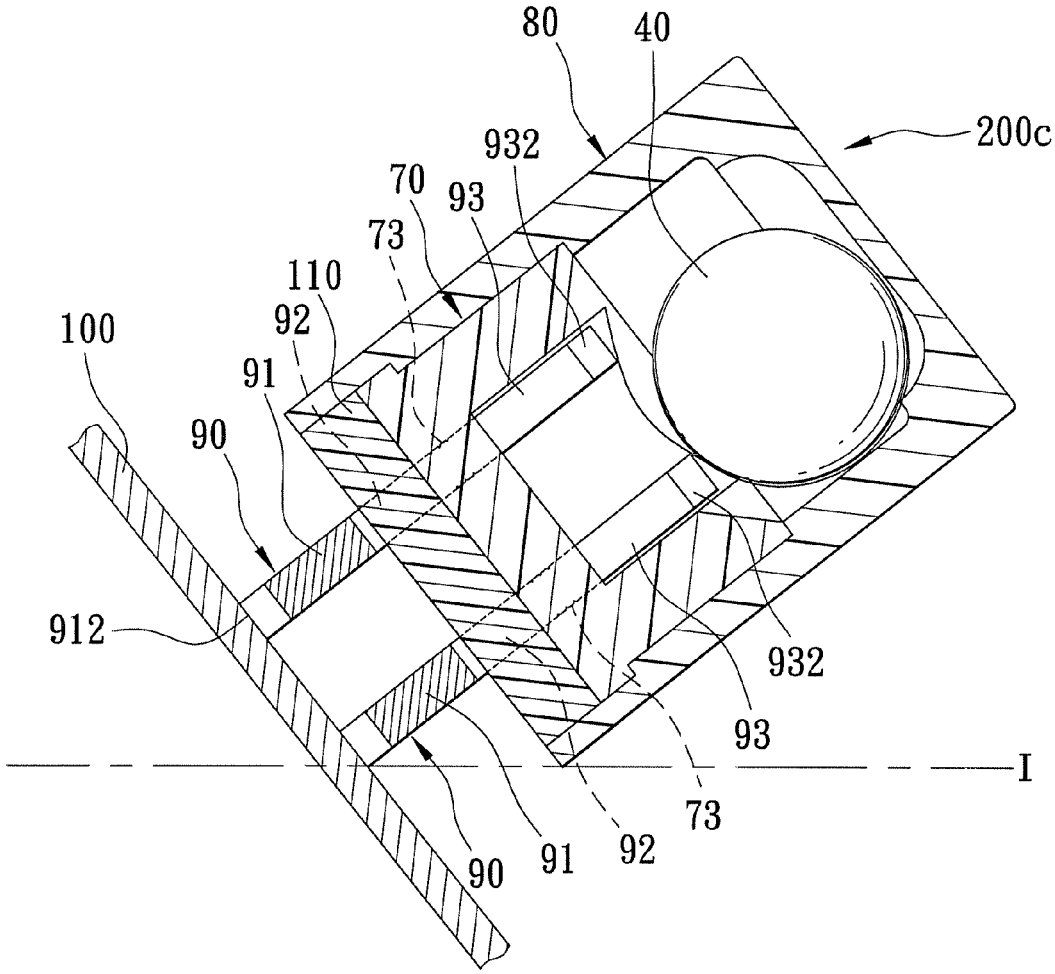
FIG. 21 is a view similar to FIG. 20, but with the rolling-ball switch of the present invention in an OFF state.

With reference to FIG. 21, when the circuit board 100 is inclined with respect to the reference horizontal surface (I) or is vibrated, the conductive ball 40 rolls away from the contact sections 932 of the terminals 93 so as to switch the switch (200*c*) from the "ON" state to an "OFF" state. The switch (200*c*) is inclined to the reference horizontal surface (I) at this time.

Figure 22:
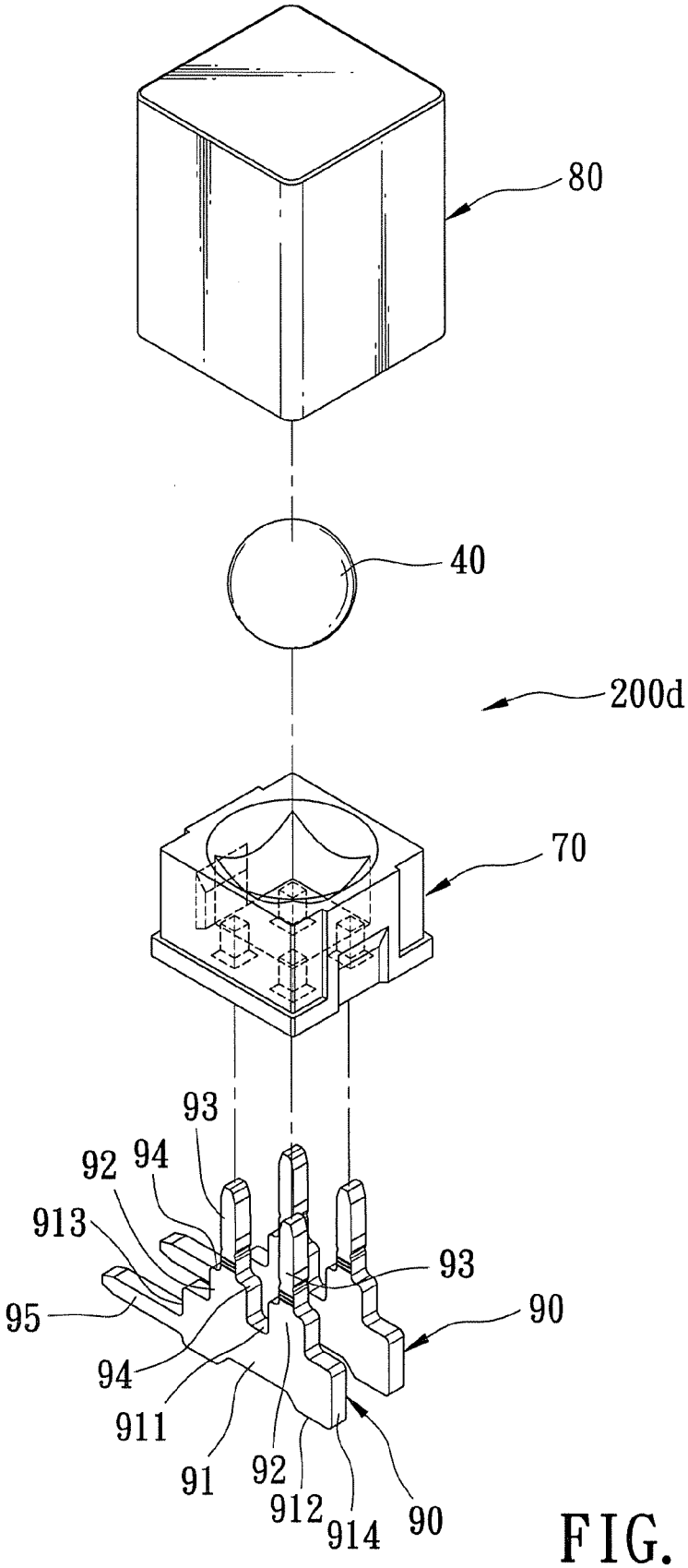
FIG. 22 is a view similar to FIG. 18, but illustrating an alternative form of a terminal unit.
Figure 23:
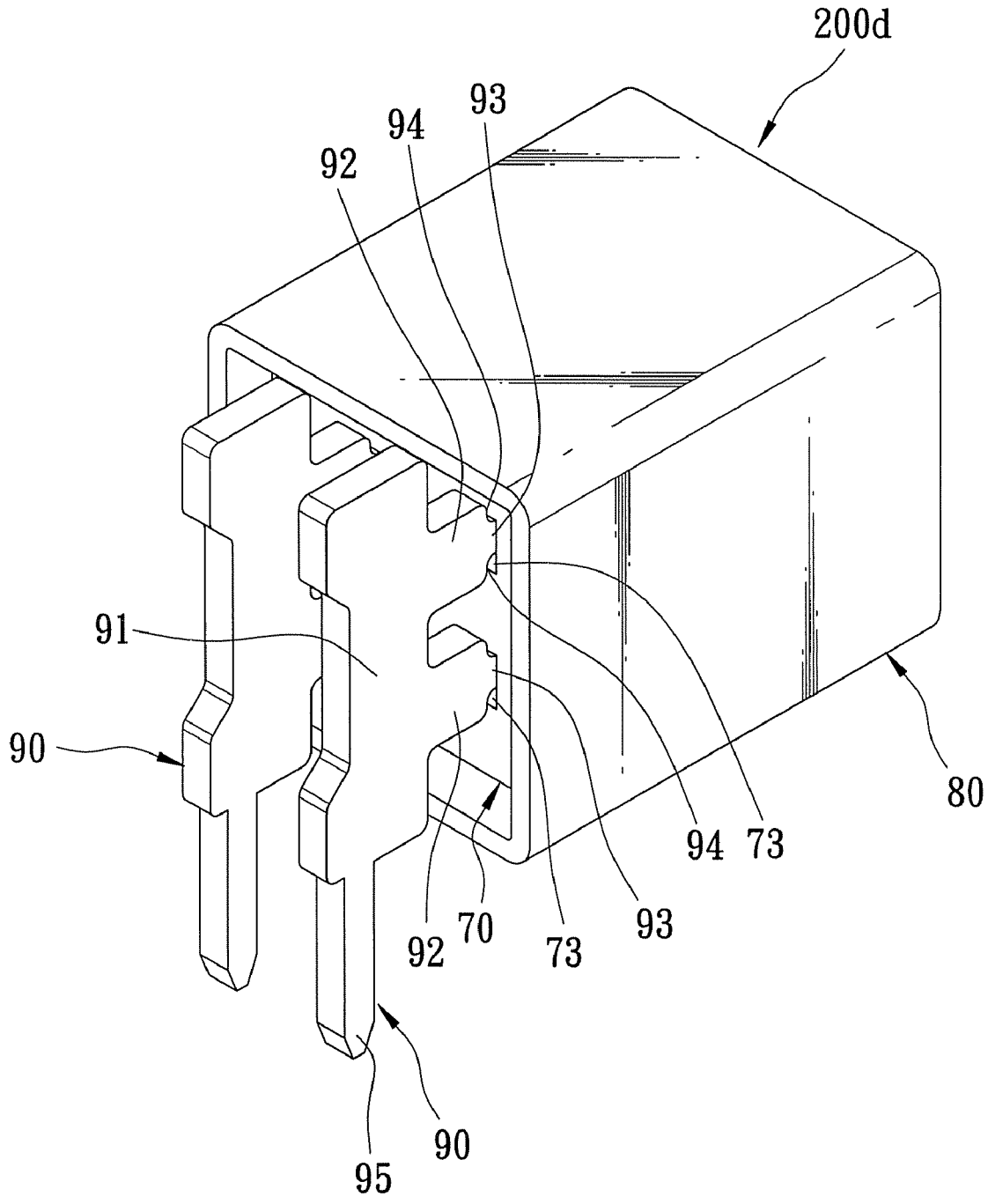
FIG. 23 is an assembled perspective view of FIG. 22.
Figure 24:
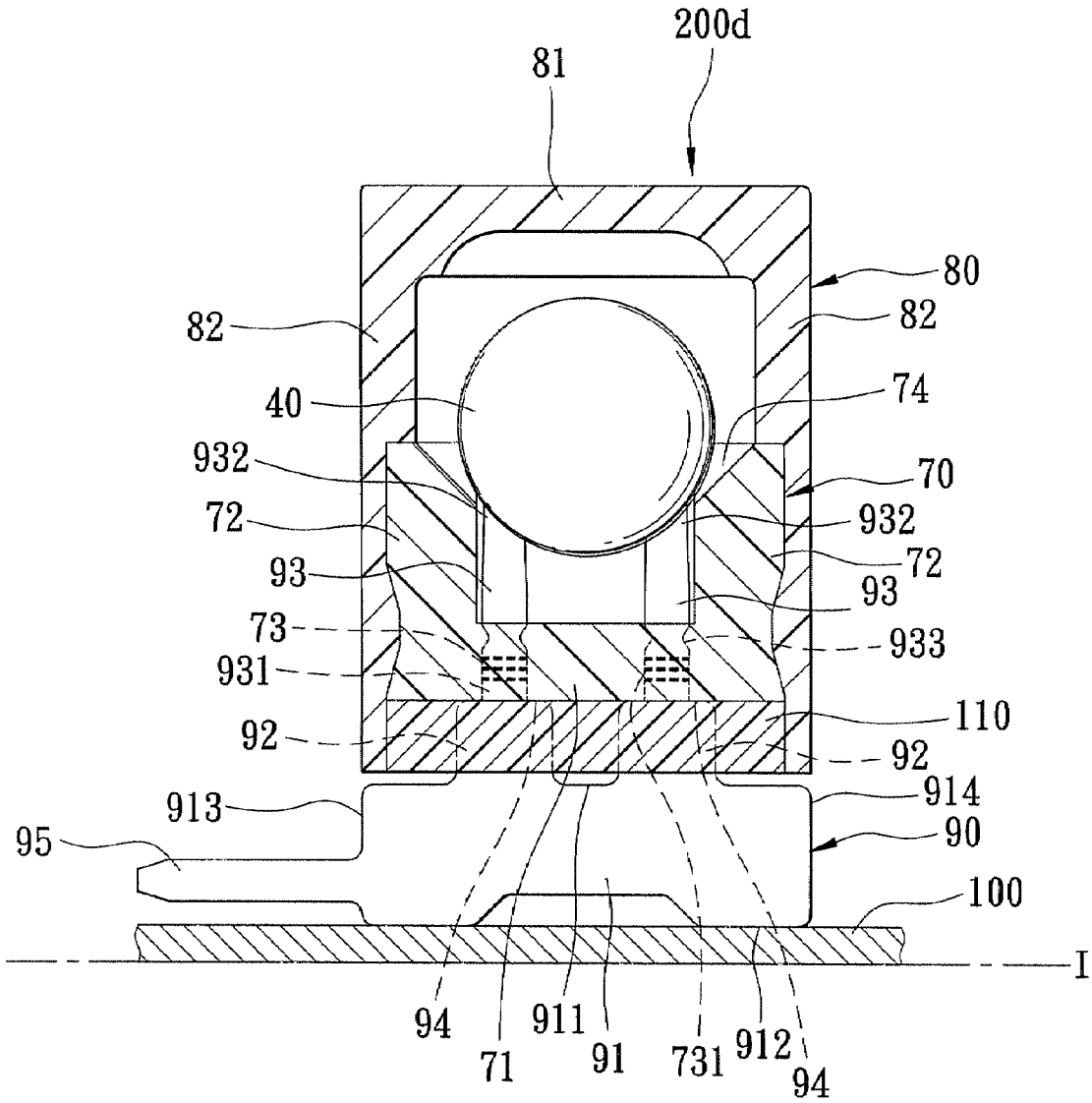
FIG. 24 is a sectional view of the third preferred embodiment in a state of use.
Figure 25:
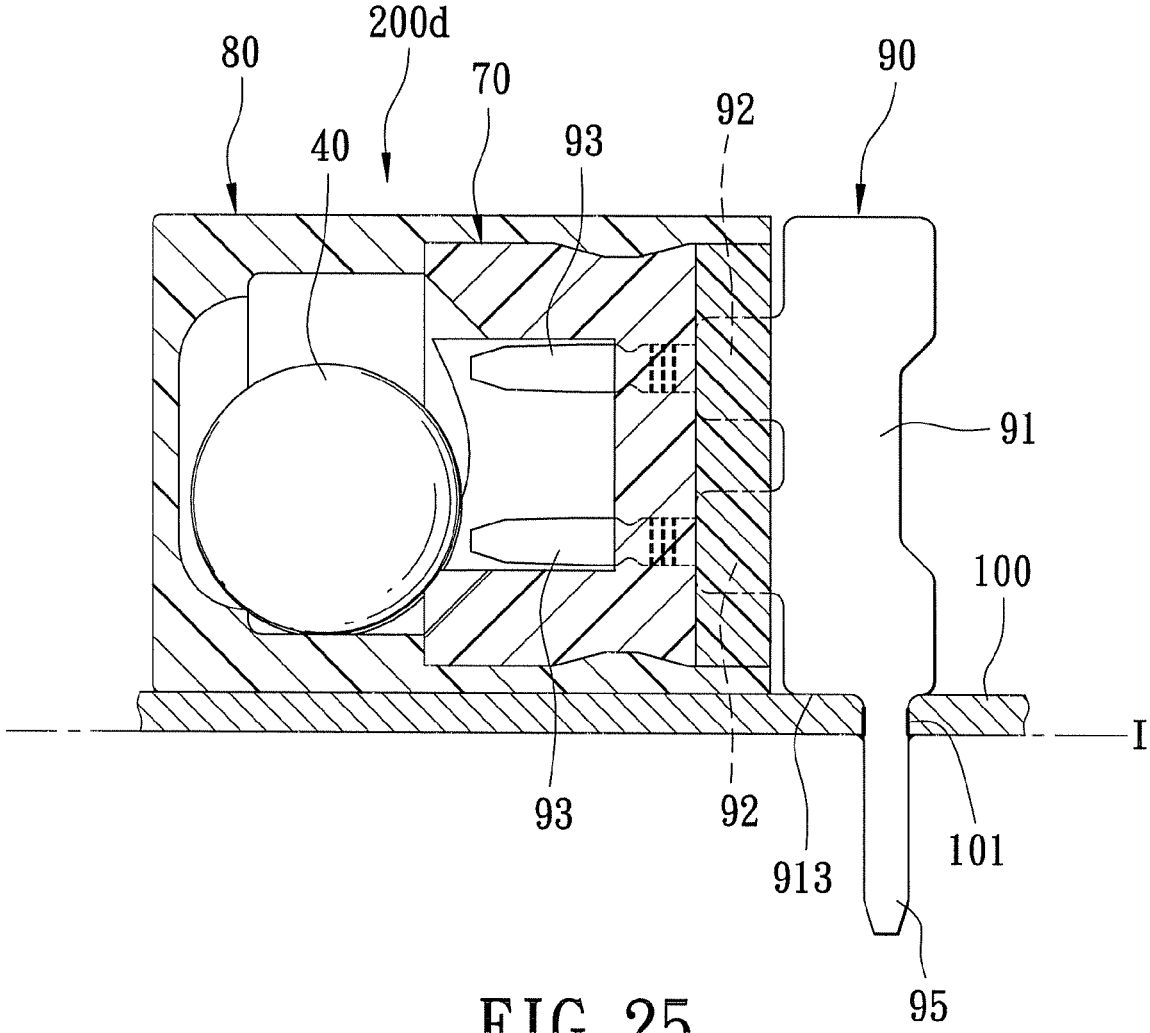
FIG. 25 is a sectional view of the third preferred embodiment in another state of use.

With reference to FIGS. 22 and 23, each of the conducting units 90 of the switch (200*d*) may further have a connecting leg 95 that extends outwardly from the second connecting surface 913 of the corresponding conducting unit 90 and that is adapted to be inserted into the circuit board 100. Alternatively, the connecting leg 95 may extend outwardly from the third connecting surface 914. In FIG. 24, the first connecting surface 912 of the connecting member 91 of each conducting unit 90 is fixed to the circuit board 100 so that the switch (200*d*) is in an "ON" state when it is vertical with respect to the reference horizontal surface (I). In FIG. 25, the connecting leg 95 of each conducting unit 90 is inserted into the insert hole 101 in the circuit board 100 until the second connecting surface 913 abuts against the circuit board 100 so that the switch (200*d*) is in an "OFF" state when it is horizontal with respect to the reference horizontal surface (I). The connecting legs 95 of the conducting units 90 are soldered to the circuit board 100 after being inserted into the corresponding insert holes 101.

Figure 26:
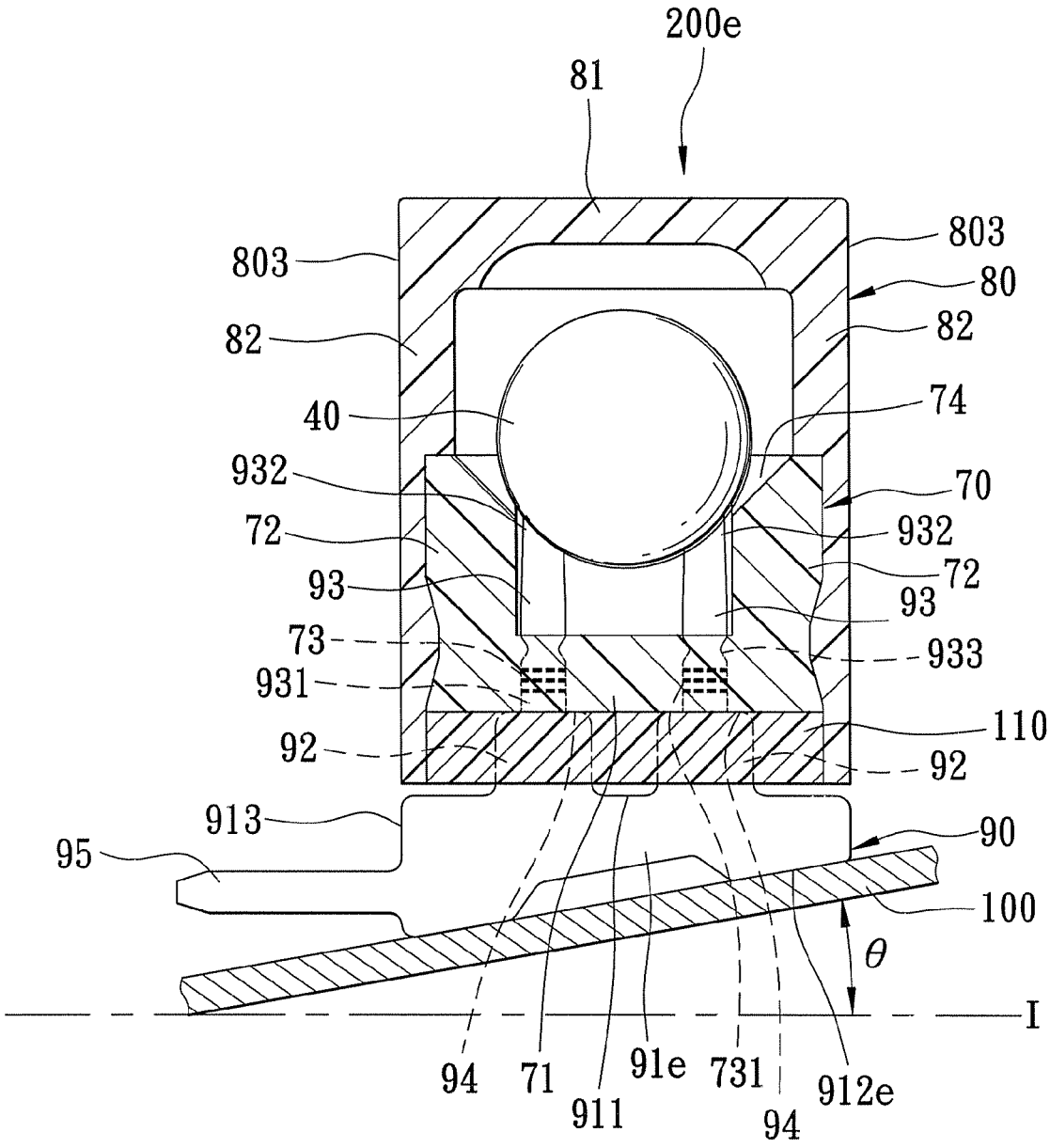
FIG. 26 is a view similar to FIG. 24, but with a first connecting surface being formed inclined relative to a horizontal surface.

With reference to FIG. 26, when the circuit board 100 is mounted inclinedly on an electronic product (not shown), the circuit board 100 is inclined with respect to the reference horizontal surface (I) at an angle θ. In this case, the first connecting surface (912*e*) of each connecting member (91*e*) can be arranged to be oblique to the bottom face 801 (see FIG. 19) of the housing of the switch (200*e*) during stamping of the conducting units 90 so that the four lateral faces 803 of the housing are inclined with respect to the circuit board 100. Hence, when the first connecting surface (912*e*) of each connecting member (91*e*) is fixed to the circuit board 100, the switch (200*e*) is in an "ON" state in its vertical position with respect to the reference horizontal surface (I).

Figure 27:
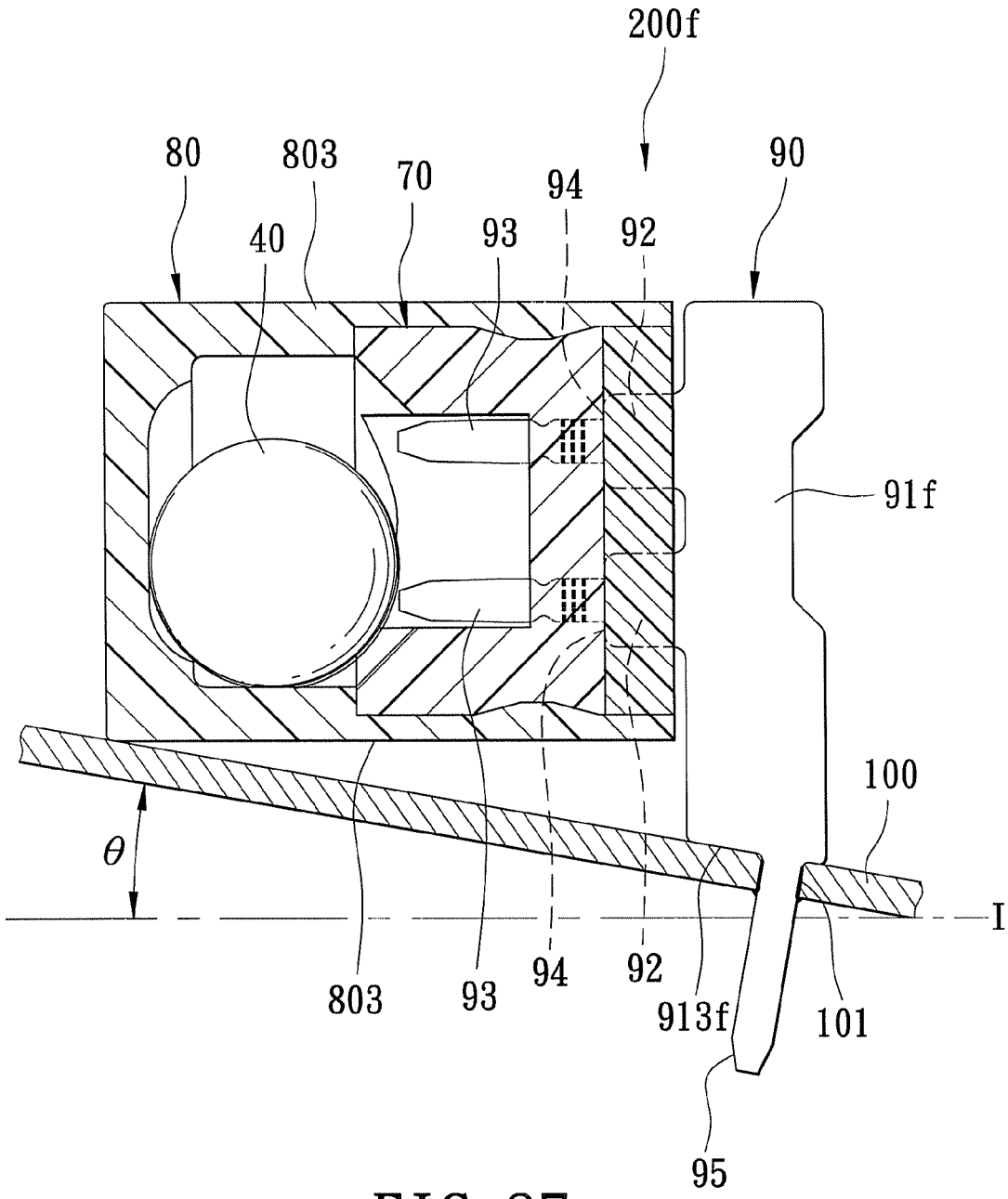
FIG. 27 is a view similar to FIG. 25, but with a second connecting surface being formed inclined relative to the horizontal surface.

With reference to FIG. 27, the second connecting surface (913*f*) of each connecting member (91*f*) may alternatively be arranged to extend in a plane oblique to an adjacent one of the four lateral faces 803 of the switch (200*f*) so that the adjacent lateral face 803 is inclined with respect to the circuit board 100. Hence, when the connecting leg 95 of each conducting unit 90 is inserted into the corresponding insert hole 101 in the circuit board 100 until the second connecting surface (913*f*) of each connecting member (91*f*) abuts against the circuit board 100, the switch (200*f*) is in an "OFF" state in its horizontal position with respect to the reference horizontal surface (I). The cover body 80 abuts against the circuit board 100 at this time to form a support point. The connecting legs 95 are soldered to the circuit board 100 after being inserted into the corresponding insert holes 101.

From the aforementioned description, the advantages of the rolling-ball switch 200, 200', 200", (200*a*-200*f*) of the present invention can be summarized as follows:

1. Because the first, second, or third connecting surfaces 612, 912, 613, 913, 614, 914, or the connecting legs 63, 95 of the conducting units 60, 90 can be fixed selectively to the circuit board 100, the orientation of the switch 200, 200', 200", (200*a*-200*f*) of the present invention can be altered to accommodate the different requirements of users without the switch 200, 200', 200", (200*a*-200*f*) having to undergo complicated manufacturing processes or use high-cost bendable materials. Ultimately, the production cost of the switch 200, 200', 200", (200*a*-200*f*) is reduced.

2. Because the terminals 62, 93 of each conducting unit 60, 90 are simply inserted interferentially into the corresponding through holes 33, 73 in the housing 30 through the use of a jig (not shown) until the abutment surface 611, 94 abuts against the bottom wall 31, 71 (i.e., the bottom face 301, 801 of the housing 30), not only is the assembly of the switch 200, 200', 200", (200*a*-200*f*) of the present invention easy, the lengths of the terminals 62 that extend into the chamber 34, 74 can be easily and accurately controlled as well.

3. Because the insert sections 621, 931 of the conducting units 60, 90 are provided with the engaging members 623, 933, the connections between the terminals 62, 93 and the bottom wall 31, 71 can be strengthened.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A rolling-ball switch adapted to be fixed on a circuit board, said rolling-ball switch comprising:

a housing defining a chamber and having a bottom wall provided with four spaced-apart through holes arranged in a rectangular array;

two conducting units respectively having plate-like connecting members disposed in parallel below said bottom wall, each of said connecting members having at least one abutment surface in abutment with said bottom wall, a first connecting surface opposite to said abutment surface, and second and third connecting surfaces extending between said abutment surface and said first connecting surface, each of said conducting units further including two terminals extending upwardly from said abutment surface of one of said connecting members into said chamber and passing respectively through two of said through holes, said two terminals being spaced apart from each other in a longitudinal direction of a corresponding one of said connecting members, said second and third connecting surfaces being opposite to each other in said longitudinal direction, said first, second, and third connecting surfaces being adapted to be selectively fixed on the circuit board; and a conductive ball disposed movably in said chamber to move toward or away from said terminals.

2. The rolling-ball switch of claim 1, wherein said housing further has a bottom face, a top face, and four lateral faces interconnecting said bottom and top faces, said bottom wall having said bottom face in abutment with said abutment surfaces of said connecting members, said bottom face being substantially perpendicular to said four lateral faces.

3. The rolling-ball switch of claim 2, wherein at least one of said second and third connecting surfaces of each of said connecting members is substantially perpendicular to said bottom face and extends substantially in the same direction as an adjacent one of said four lateral faces so that said adjacent one of said four lateral faces is substantially parallel to the circuit board when said one of said second and third connecting surfaces is fixed to the circuit board.

4. The rolling-ball switch of claim 2, wherein at least one of said second and third connecting surfaces of each of said connecting members extends in a plane oblique to an adjacent one of said four lateral faces so that said adjacent one of said four lateral faces is inclined with respect to the circuit board when said one of said second and third connecting surfaces is fixed to the circuit board.

5. The rolling-ball switch of claim 2, wherein said first connecting surface of each of said connecting members is substantially parallel to said bottom face so that said four lateral faces are substantially perpendicular to the circuit board when said first connecting surface is fixed to the circuit board.

6. The rolling-ball switch of claim 2, wherein said first connecting surface of each of said connecting members is oblique to said bottom face so that said four lateral faces are inclined with respect to the circuit board when said first connecting surface is fixed to the circuit board.

7. The rolling-ball switch of claim 1, wherein each of said through holes is defined by a four-sided hole wall, each of said terminals including an insert section extending upwardly from said abutment surface and inserted into a corresponding one of said through holes, a contact section extending from said insert section into said chamber, and an engaging member provided on said insert section and engaging said hole wall of the corresponding one of said through holes, said conductive ball being capable of contacting said contact sections of said terminals.

8. The rolling-ball switch of claim 7, wherein said engaging member is configured as an indentation.

9. The rolling-ball switch of claim 7, wherein said engaging member is configured as a protrusion.

10. The rolling-ball switch of claim 1, wherein each of said conducting units further includes a connecting leg that extends outwardly from one of said second and third connecting surfaces and that is adapted to be inserted into the circuit board.

11. The rolling-ball switch of claim 1, wherein said chamber has a lower section proximate to said bottom face, an upper section having a cross-section larger than that of said lower section, and a tapering section extending downward from said upper section to said lower section, said terminals of said conducting units having contact sections that are provided with substantially the same height and that extend into said tapering section, said conductive ball being movable toward or away from said contact sections.

12. The rolling-ball switch of claim 1, wherein two of said terminals of said conducting units having long lengths, the other two of said terminals of said conducting units having short lengths shorter than said long lengths and including contact sections, said conductive ball being in rolling contact with said terminals having said long lengths while moving toward or away from said contact sections of said terminals having said short lengths.

13. The rolling-ball switch of claim 2, wherein each of said connecting members further has a fourth surface opposite to said first connecting surface, and two spaced-apart upward protrusions extending upwardly from said fourth surface, each of said upward protrusions having said abutment surface, each of said terminals extending upwardly from said abutment surface of a corresponding one of said upward protrusions.

14. The rolling-ball switch of claim 13, wherein:

said housing includes a bottom seat having said bottom wall and four interconnected lower side walls extending upwardly from said bottom wall, and a cover body having a top wall and four interconnected upper side walls extending downwardly from said top wall and surrounding said lower side walls, said bottom and top walls and said lower and upper side walls cooperatively defining said chamber;

said bottom wall has said bottom face, said upper side walls respectively having said lateral faces, said top wall having said top face, said abutment surfaces of each of said connecting members abutting against said bottom face; and said housing further includes a sealing member formed within said upper side walls and between said bottom face and each of said fourth surfaces of said connecting members, said protrusions of said connecting members being embedded within said sealing member.

* * * * *